US011462169B2

(12) United States Patent
Lee et al.

(10) Patent No.: US 11,462,169 B2
(45) **Date of Patent: *Oct. 4, 2022**

(54) PIXEL AND RELATED ORGANIC LIGHT EMITTING DIODE DISPLAY DEVICE

(71) Applicant: Samsung Display Co., Ltd., Yongin-Si (KR)

(72) Inventors: Hyo Jin Lee, Yongin-si (KR); Sangan Kwon, Cheonan-si (KR); Jin Young Roh, Hwaseong-si (KR); Sehyuk Park, Seongnam-si (KR)

(73) Assignee: Samsung Display Co., Ltd.

( * ) Notice: Subject to any disclaimer, the term of this patent is extended or adjusted under 35 U.S.C. 154(b) by 0 days.

This patent is subject to a terminal disclaimer.

(21) Appl. No.: 17/307,969

(22) Filed: May 4, 2021

(65) Prior Publication Data

US 2021/0256911 A1 Aug. 19, 2021

Related U.S. Application Data

(63) Continuation of application No. 16/868,463, filed on May 6, 2020, now Pat. No. 11,017,723.

(30) Foreign Application Priority Data

Oct. 14, 2019 (KR) ..... 10-2019-0126965

(51) Int. Cl.
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2320/02* (2013.01);
(Continued)

(58) Field of Classification Search
CPC ..... G09G 3/3258; G09G 3/3233; G09G 2300/0819; G09G 2300/0876;
(Continued)

(56) References Cited

U.S. PATENT DOCUMENTS 9,035,976 B2 * 5/2015 Lee ..... G09G 3/3283 345/691
10,417,961 B2 * 9/2019 Xiang ..... G09G 3/3233
(Continued)

FOREIGN PATENT DOCUMENTS

KR 10-2013-0118459 A 10/2013
KR 10-2016-0113416 A 9/2016
(Continued)

*Primary Examiner* — Tom V Sheng
(74) *Attorney, Agent, or Firm* — Innovation Counsel LLP

(57) ABSTRACT

A pixel of a display device includes a capacitor; a light emitting diode; and first, second, third, and fourth transistors. The display device has a normal frequency mode and a low frequency mode. Two electrodes of the capacitor are respectively connected to a first voltage source and a gate node. A gate electrode of the first transistor is connected to the gate node. In a hold period in the low frequency mode, both the second and third transistors receive a scan signal, the third transistor diode-connects the first transistor, the fourth transistor receives an initialization signal and transfers an initialization voltage to the gate node, the scan signal is at a first off voltage level, and the initialization signal is at a second off voltage level unequal to the first off voltage level. The cathode of the light emitting diode is connected to a second voltage source.

20 Claims, 26 Drawing Sheets

(52) U.S. Cl.
CPC ..... *G09G 2320/0233* (2013.01); *G09G 2330/028* (2013.01)

(58) Field of Classification Search
CPC ..... G09G 2320/02; G09G 2320/0233; G09G 2320/043; G09G 2320/045; G09G 2330/028
USPC ..... 345/214
See application file for complete search history.

(56) References Cited

U.S. PATENT DOCUMENTS

| | | | | |
|---|---|---|---|---|
| 10,629,121 | B2 * | 4/2020 | Zhu | G09G 3/3233 |
| 11,017,723 | B2 * | 5/2021 | Lee | G09G 3/3258 |
| 2012/0146999 | A1 * | 6/2012 | Hwang | G09G 3/003 345/419 |
| 2013/0120228 | A1 * | 5/2013 | Yoon | G09G 3/3291 345/80 |
| 2013/0127692 | A1 * | 5/2013 | Yoon | G09G 3/3258 345/80 |
| 2014/0035799 | A1 * | 2/2014 | Bae | G09G 3/3266 345/82 |
| 2017/0092191 | A1 * | 3/2017 | An | G09G 3/3233 |
| 2017/0256200 | A1 | 9/2017 | Duan et al. | |
| 2017/0323609 | A1 * | 11/2017 | Zhao | H03K 17/6871 |
| 2018/0233085 | A1 * | 8/2018 | Wang | G09G 3/3233 |
| 2019/0096330 | A1 * | 3/2019 | Kim | G09G 3/3266 |
| 2019/0164498 | A1 * | 5/2019 | Jang | G09G 3/3266 |
| 2019/0206320 | A1 * | 7/2019 | Nam | G09G 3/3233 |
| 2020/0279532 | A1 * | 9/2020 | Park | G09G 3/3233 |
| 2021/0049958 | A1 * | 2/2021 | Kim | G09G 3/3233 |

FOREIGN PATENT DOCUMENTS

| | | | |
|---|---|---|---|
| KR | 10-2016-0148827 | A | 12/2016 |
| KR | 10-2017-0060662 | A | 6/2017 |

* cited by examiner

PIXEL AND RELATED ORGANIC LIGHT EMITTING DIODE DISPLAY DEVICE

CROSS-REFERENCE TO RELATED APPLICATION(S)

This application is a continuation application of U.S. patent application Ser. No. 16/868,463 filed May 6, 2020, which claims priority under 35 USC § 119 to Korean Patent Application No. 10-2019-0126965 filed on Oct. 14, 2019 in the Korean Intellectual Property Office (KIPO); the Korean Patent Application is incorporated by reference.

BACKGROUND

1. Field

The technical field relates to a pixel of an organic light emitting diode display device and the organic light emitting diode display device.

2. Description of the Related Art

Reduction of power consumption may be desirable in an organic light emitting diode (OLED) display device employed in a portable device, such as a smartphone or a tablet computer. In order to reduce the power consumption of an OLED display device, the OLED display device may operate at a relatively low frequency driving when displaying a still image. When performing low frequency driving, the OLED display device may display an image based on stored data signals, thereby reducing the power consumption.

When the OLED display device displays an image based on the stored data signals, the stored data signals may be distorted by leakage currents of transistors included in pixels of the OLED display device. As a result, quality of images displayed by the OLED display device may be unsatisfactory.

SUMMARY

Some embodiments may be related to a pixel and a related organic light emitting diode (OLED) display device. The OLED display device may display images with satisfactory quality at low frequency driving.

According to embodiments, a pixel of an organic light emitting diode display device includes the following elements: a capacitor including a first electrode coupled to a line of a first power supply voltage, and a second electrode coupled to a gate node, a first transistor including a gate electrode coupled to the gate node, a second transistor configured to transfer a data signal to a source of the first transistor in response to a scan signal, a third transistor configured to diode-connect the first transistor in response to the scan signal, a fourth transistor configured to transfer an initialization voltage to the gate node in response to an initialization signal, and an organic light emitting diode including an anode, and a cathode coupled to a line of a second power supply voltage. In a low frequency hold period, the scan signal applied to the third transistor has a first off voltage level, and the initialization signal applied to the fourth transistor has a second off voltage level that is different from the first off voltage level.

In embodiments, in a low frequency driving mode where a display panel of the organic light emitting diode display device is driven a low frequency lower than a normal driving frequency, at least one of a plurality of consecutive frame periods may be set as the low frequency hold period.

In embodiments, in a normal driving period where a display panel of the organic light emitting diode display device is driven, the scan signal and the initialization signal may have an on voltage level in different times, and each of the scan signal and the initialization signal may be changed to a third off voltage level after the on voltage level. In the low frequency hold period where the display panel is not driven, the scan signal applied to the third transistor may have the first off voltage level substantially the same as the third off voltage level, and the initialization signal applied to the fourth transistor may be increased from the third off voltage level to the second off voltage level higher than the third off voltage level.

In embodiments, in the low frequency hold period, a leakage current of the fourth transistor from the gate node to a line of the initialization voltage may be increased based on the initialization signal having the second off voltage level higher than the third off voltage level.

In embodiments, a difference between the second off voltage level and the third off voltage level may be determined according to a driving frequency for the display panel.

In embodiments, in a normal driving period where a display panel of the organic light emitting diode display device is driven, the scan signal and the initialization signal may have an on voltage level in different times, and each of the scan signal and the initialization signal may be changed to a third off voltage level after the on voltage level. In the low frequency hold period where the display panel is not driven, the scan signal applied to the third transistor may be increased from the third off voltage level to the first off voltage level higher than the third off voltage level, and the initialization signal applied to the fourth transistor may have the second off voltage level substantially the same as the third off voltage level.

In embodiments, in the low frequency hold period, a leakage current of the third transistor from the gate node to a drain of the first transistor may be increased based on the scan signal having the first off voltage level higher than the third off voltage level.

In embodiments, in a normal driving period where a display panel of the organic light emitting diode display device is driven, the scan signal and the initialization signal may have an on voltage level in different times, and each of the scan signal and the initialization signal may be changed to a third off voltage level after the on voltage level. In the low frequency hold period where the display panel is not driven, the scan signal applied to the third transistor may have the first off voltage level substantially the same as the third off voltage level, and the initialization signal applied to the fourth transistor may be decreased from the third off voltage level to the second off voltage level lower than the third off voltage level.

In embodiments, in the low frequency hold period, a leakage current of the fourth transistor from the gate node may be decreased based on the initialization signal having the second off voltage level lower than the third off voltage level.

In embodiments, in a normal driving period where a display panel of the organic light emitting diode display device is driven, the scan signal and the initialization signal may have an on voltage level in different times, and each of the scan signal and the initialization signal may be changed to a third off voltage level after the on voltage level. In the low frequency hold period where the display panel is not driven, the scan signal applied to the third transistor may be decreased from the third off voltage level to the first off voltage level lower than the third off voltage level, and the initialization signal applied to the fourth transistor may have the second off voltage level substantially the same as the third off voltage level.

In embodiments, in the low frequency hold period, a leakage current of the third transistor from the gate node may be decreased based on the scan signal having the first off voltage level lower than the third off voltage level.

In embodiments, the third transistor may include first and second sub-transistors that are coupled in series between the gate node and a drain of the first transistor, and the fourth transistor may include third and fourth sub-transistors that are coupled in series between the gate node and a line of the initialization voltage.

In embodiments, the pixel may further include a fifth transistor including a gate electrode receiving an emission signal, a source coupled to the line of the first power supply voltage, and a drain coupled to the source of the first transistor, a sixth transistor including a gate electrode receiving the emission signal, a source coupled to a drain of the first transistor, and a drain coupled to the anode of the organic light emitting diode, and a seventh transistor including a gate electrode receiving the initialization signal, a source coupled to the anode of the organic light emitting diode, and a drain coupled to a line of the initialization voltage.

According to embodiments, a pixel of an organic light emitting diode display device includes the following elements: a capacitor including a first electrode coupled to a line of a first power supply voltage, and a second electrode coupled to a gate node, a first transistor including a gate electrode coupled to the gate node, a second transistor configured to transfer a data signal to a source of the first transistor in response to a scan signal, a third transistor configured to diode-connect the first transistor in response to the scan signal, a fourth transistor configured to transfer an initialization voltage to the gate node in response to an initialization signal, and an organic light emitting diode including an anode, and a cathode coupled to a line of a second power supply voltage. In a low frequency hold period, at least one of the scan signal applied to the third transistor and the initialization signal applied to the fourth transistor is changed from a first off voltage level to a second off voltage level that is different from the first off voltage level.

According to embodiments, an organic light emitting diode (OLED) display device includes the following elements: a display panel including a plurality of pixels, a data driver configured to provide data signals to the plurality of pixels, a power management circuit configured to generate a gate on voltage and a gate off voltage, a scan driver including an initialization stage group configured to sequentially provide initialization signals to the plurality of pixels based on the gate on voltage and the gate off voltage, and a scan stage group configured to sequentially provide scan signals to the plurality of pixels based on the gate on voltage and the gate off voltage, and a controller configured to control the data driver, the power management circuit and the scan driver. In a normal driving period, the power management circuit provides a first gate off voltage as the gate off voltage to the initialization stage group and the scan stage group. In a low frequency hold period, the power management circuit provides the first gate off voltage as the gate off voltage to a first group of the initialization stage group and the scan stage group, and provides a second gate off voltage different from the first gate off voltage as the gate off voltage to a second group of the initialization stage group and the scan stage group.

In embodiments, the power management circuit may include a switching block configured to receive a hold flag signal representing the low frequency hold period from the controller, and to selectively provide the first gate off voltage or the second gate off voltage as the gate off voltage to the second group in response to the hold flag signal.

In embodiments, the switching block may include a first switch configured to provide the first gate off voltage as the gate off voltage to the second group in response to the hold flag signal, and a second switch configured to provide the second gate off voltage as the gate off voltage to the second group in response to the hold flag signal.

In embodiments, the controller may include a still image detector configured to receive input image data at an input frame frequency, and to determine whether the input image data represents a still image. In a case where the input image data represents the still image, the controller may set at least one of a plurality of consecutive frame periods as the low frequency hold period such that the display panel is driven at a low frequency lower than the input frame frequency.

In embodiments, the display panel may be divided into a plurality of panel regions. The controller may include a still image detector configured to receive input image data at an input frame frequency, to divide the input image data for the display panel into a plurality of partial image data for the plurality of panel regions, and to determine whether each of the plurality of partial image data represents a still image. In a case where at least one partial image data of the plurality of partial image data represents the still image, the controller may set at least one of a plurality of consecutive frame periods as the low frequency hold period with respect to a corresponding one of the plurality of panel regions corresponding to the at least one partial image data such that the corresponding one of the plurality of panel regions is driven at a low frequency lower than the input frame frequency.

In embodiments, the second group may include a plurality of stage sub-groups respectively coupled to the plurality of panel regions. The power management circuit may include a plurality of switching blocks configured to selectively provide the first gate off voltage or the second gate off voltage as the gate off voltage to the plurality of stage sub-groups, respectively.

An embodiment may be related to a pixel of a display device. The display device may have (i.e., may operate in) a first mode and a second mode. A driving frequency of the display device in the second mode may be lower than a driving frequency of the display device in the first mode. The pixel may include a capacitor, a first transistor, a second transistor, a third transistor, a fourth transistor, and an organic light emitting diode. A first electrode of the capacitor may receive a first power supply voltage. A second electrode of the capacitor may be electrically connected to a gate node. A gate electrode of the first transistor may be electrically connected to the gate node. A drain electrode of the second transistor may be electrically connected to a source electrode of the first transistor. A gate electrode of the second transistor may receive a first instance of a scan signal in a hold period in the second mode. The third transistor may diode-connect the first transistor in response to a second instance of the scan signal in the hold period in the second mode. The fourth transistor may transfer an initialization voltage to the gate node in response to a first instance of an initialization signal in the hold period in the second mode. The organic light emitting diode may include an anode and a cathode.

The cathode may receive a second power supply voltage different from the first power supply voltage. In the hold period in the second mode, the scan signal and the initialization signal may have different off voltage levels.

The hold period may include one of consecutive frame periods in the second mode.

In a frame period in the first mode, the scan signal may change from an on voltage level to a first off voltage level at a first time, and the initialization signal may change from the on level to the first off voltage level at a second time different from the first time. In the hold period in the second mode, the initialization signal may be increased from the first off voltage level to a second off voltage level higher than the first off voltage level.

In the hold period in the second mode, a leakage current of the fourth transistor may be increased based on a difference between the second off voltage level and the first off voltage level.

A difference between the second off voltage level and the first off voltage level may depend on the driving frequency of the second mode.

In a frame period in the first mode, the scan signal may change from an on voltage level to a first off voltage level at a first time, and the initialization signal may change from the on level to the first off voltage level at a second time different from the first time. In the hold period in the second mode, the scan signal may be increased from the first off voltage level to a second off voltage level higher than the first off voltage level.

In the hold period in the second mode, a leakage current of the third transistor from the gate node to a drain electrode of the first transistor may be increased based on a difference between the first off voltage level and the second off voltage level.

In a frame period in the first mode, the scan signal may change from an on voltage level to a first off voltage level at a first time, and the initialization signal may change from the on level to the first off voltage level at a second time different from the first time. In the hold period in the second mode, the initialization signal may be decreased from the first off voltage level to a second off voltage level lower than the first off voltage level.

In the hold period in the second mode, a leakage current of the fourth transistor may be decreased based on a difference between the second off voltage level and the first off voltage level.

In a frame period in the first mode, the scan signal may change from an on voltage level to a first off voltage level at a first time, and the initialization signal may change from the on level to the first off voltage level at a second time different from the first time. In the hold period in the second mode, the scan signal may be decreased from the first off voltage level to a second off voltage level lower than the first off voltage level.

In the hold period in the second mode, a leakage current of the third transistor may be decreased based on a difference between the first off voltage level and the second off voltage level.

The third transistor may include a first sub-transistor and a second sub-transistor that are electrically connected in series between the gate node and a drain of the first transistor. The fourth transistor may include a third sub-transistor and a fourth sub-transistor that are electrically connected in series between the gate node and a source of the initialization voltage.

The pixel may include a fifth transistor, a sixth transistor, and a seventh transistor. A gate electrode of the fifth transistor may be electrically connected to an emission signal source. A source electrode of the fifth transistor may receive the first power supply voltage. A drain electrode of the fifth transistor may be electrically connected to the source electrode of the first transistor. A gate electrode of the sixth transistor may be electrically connected to the emission signal source. A source electrode may be electrically connected to a drain electrode of the first transistor. A drain of the sixth transistor may be electrically connected to the anode of the organic light emitting diode. A gate electrode of the seventh transistor may receive a second instance of the initialization signal. A source electrode of the seventh transistor may be electrically connected to the anode of the organic light emitting diode. A drain electrode of the seventh transistor may be electrically connected to a source of the initialization voltage.

An embodiment may be related to a pixel of a display device. The display device may have (i.e., may operate in) a first mode and a second mode. A driving frequency of the display device in the second mode may be lower than a driving frequency of the display device in the first mode. The pixel may include a capacitor, a first transistor, a second transistor, a third transistor, a fourth transistor, and an organic light emitting diode. A first electrode of the capacitor may receive a first power supply voltage. A second electrode of the capacitor may be electrically connected to a gate node. A gate electrode of the first transistor may be electrically connected to the gate node. A drain electrode of the second transistor may be electrically connected to a source electrode of the first transistor. A gate electrode of the second transistor may receive a first instance of a scan signal in a hold period in the second mode. The third transistor may diode-connect the first transistor in response to a second instance of the scan signal in the hold period in the second mode. The fourth transistor may transfer an initialization voltage to the gate node in response to a first instance of an initialization signal in the hold period in the second mode. The organic light emitting diode may include an anode and a cathode. The cathode may receive a second power supply voltage different from the first power supply voltage. At an end of a frame period in the first mode, each of the scan signal and the initialization signal may be at a first off voltage level. In a hold period in the second mode, at least one of the scan signal and the initialization signal may be at a second off voltage level unequal to the first off voltage level.

An embodiment may be related to an organic light emitting diode (OLED) display device. The OLED display device may include the following elements: a display panel including pixels; a data driver electrically connected to the display panel and configured to provide data signals to the pixels; a power management circuit; a scan driver electrically connected to the power management circuit, electrically connected to the display panel, and including an initialization stage group configured to sequentially provide initialization signals to the pixels, and a scan stage group configured to sequentially provide scan signals to the pixels; and a controller configured to control the data driver, the power management circuit, and the scan driver. In a frame period in a first mode of the OLED display device, the power management circuit may provide a first gate off voltage to each of the initialization stage group and the scan stage group. In a hold period in a second mode of the OLED display device, the power management circuit may provide the first gate off voltage to a first one of the initialization stage group and the scan stage group, and may provide a second gate off voltage unequal to the first gate off voltage to a second one of the initialization stage group and the scan stage group.

The power management circuit may include a switching block. The switching block may receive a hold flag signal from the controller. The switching block may selectively provide the first gate off voltage or the second gate off voltage to the second one of the initialization stage group and the scan stage group in response to the hold flag signal.

The switching block may include a first switch and a second switch. The first switch may provide the first gate off voltage to the second one of the initialization stage group and the scan stage group in response to the hold flag signal. The second switch may provide the second gate off voltage to the second one of the initialization stage group and the scan stage group in response to the hold flag signal.

The controller may include a still image detector. The image detector may receive input image data at an input frame frequency. When the still image detector determines that the input image data represents a still image, the controller may set at least one of consecutive frame periods as the hold period in the second mode, such that the display panel may operate in the second mode at a frequency lower than the input frame frequency.

The display panel may be divided into panel regions. The controller may include a still image detector. The still image detector may receive input image data for the display panel at an input frame frequency and may divide the input image data into partial image data sets for the panel regions, respectively. When the still image detector determines that an identified partial image data set of the partial image data sets represents a still image, the controller may set at least one of consecutive frame periods as the hold period in the second mode for a corresponding panel region of the panel regions that corresponds to the identified partial image data set, such that the corresponding panel region may operate in the second mode at a frequency lower than the input frame frequency.

The second one of the initialization group and the scan stage group may include stage sub-groups respectively electrically connected to the panel regions. The power management circuit may include switching blocks respectively electrically connected to the stage sub-groups and configured to selectively provide the first gate off voltage or the second gate off voltage to each of the stage sub-groups.

In embodiments, in a low frequency hold period, an off voltage level of at least one of a scan signal applied to a third transistor (e.g., a threshold voltage compensating transistor) and an initialization signal applied to a fourth transistor (e.g., a gate initializing transistor) may be unequal to the voltage level in a normal frequency frame period. Advantageously, a voltage distortion of a gate node of a first transistor (e.g., a driving transistor) at low frequency driving may be compensated, and satisfactory image quality of the organic light emitting diode display device may be attained.

DETAILED DESCRIPTION OF EMBODIMENTS

Embodiments are described with reference to the accompanying drawings. Although the terms "first," "second," etc. may be used to describe various elements, these elements should not be limited by these terms. These terms may be used to distinguish one element from another element. A first element may be termed a second element without departing from teachings of one or more embodiments. The description of an element as a "first" element may not require or imply the presence of a second element or other elements. The terms "first," "second," etc. may be used to differentiate different categories or sets of elements. For conciseness, the terms "first," "second," etc. may represent "first-type (or first-set)," "second-type (or second-set)," etc., respectively. The term "connect" or the term "couple" may mean "electrically connect" or "electrically connected through no intervening transistor." The term "insulate" may mean "electrically insulate" or "electrically isolate." The term "drive" may mean "operate" or "control." A "source" of a transistor may mean a "source electrode" of the transistor. A "drain" of a transistor may mean a "drain electrode" of the transistor. A "gate" of a transistor may mean a "gate electrode" of the transistor. The term "different" may mean "unequal." The term "different from" may mean "unequal to." The term "the same as" may mean "equal to." The expression that a signal has a voltage level may mean that the signal is at the voltage level; for example, "a scan signal having a voltage level of a second gate off level" may mean "a scan signal at a voltage level of a second gate off level" or "a scan signal at a second gate off level."

Figure 1:
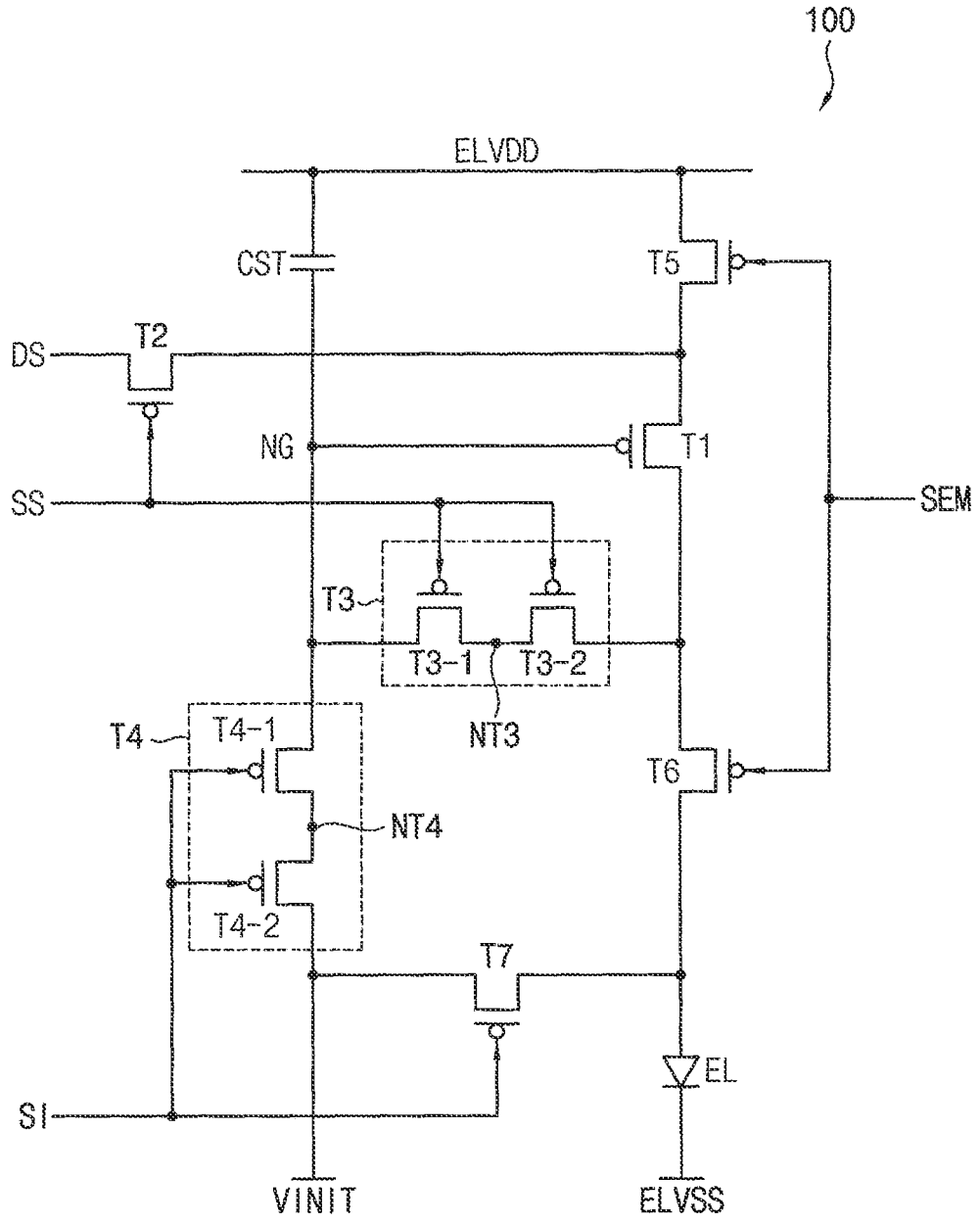
FIG. 1 is a circuit diagram illustrating a pixel of an organic light emitting diode display device according to embodiments.

FIG. 1 is a circuit diagram illustrating a pixel of an organic light emitting diode display device according to embodiments.

Referring to FIG. 1, a pixel 100 of an organic light emitting diode display device may include a capacitor CST, a first transistor T1, a second transistor T2, a third transistor T3, a fourth transistor T4, and an organic light emitting diode EL. The pixel 100 may further include a fifth transistor T5, a sixth transistor T6, and a seventh transistor T7.

The capacitor CST may store a data signal DS transferred through the second transistor T2 and the (diode-connected) first transistor T1. The capacitor CST may be referred to as a storage capacitor. The capacitor CST may include a first electrode coupled to a line of a first power supply voltage ELVDD and may include a second electrode coupled to a gate node NG.

The first transistor T1 may generate a driving current based on the data signal DS stored in the capacitor CST or based on a voltage of the gate node NG. The first transistor T1 may be referred to as a driving transistor for driving the organic light emitting diode EL. The first transistor T1 may include a gate electrode coupled to the second electrode of the capacitor CST (through the gate node NG), a source electrode coupled to the line of the first power supply voltage ELVDD (through the fifth transistor T5), and a drain electrode coupled to the organic light emitting diode EL (through the sixth transistor T6).

The second transistor T2 may transfer the data signal DS toward/to the source of the first transistor T1 in response to (a first instance of) a scan signal SS. The second transistor T2 may be referred to as a switching transistor or a scan transistor for transferring the data signal DS of a data line. The second transistor T2 may include a gate electrode receiving the scan signal SS, a source receiving the data signal DS, and a drain coupled to the source of the first transistor T1.

The third transistor T3 may diode-connect the first transistor T1 (by electrically connecting the drain of the first transistor T1 to the gate of the first transistor T1) in response to (a second instance of) the scan signal SS. The third transistor T3 may be referred to as a threshold voltage compensating transistor for compensating a threshold voltage of the first transistor T1. The third transistor T3 may include a gate electrode receiving the scan signal SS, a drain coupled to the drain of the first transistor T1, and a source coupled to the gate electrode of the first transistor T1 (through the gate node NG). When the scan signal SS is applied, the data signal DS transferred by the second transistor T2 may be provided to the capacitor CST through the first transistor T1 that is diode-connected by the third transistor T3. Accordingly, the capacitor CST may store the data signal DS when the threshold voltage of the first transistor T1 is compensated.

The fourth transistor T4 may transfer an initialization voltage VINIT to the gate node NG in response to (a first instance of) an initialization signal SI. The fourth transistor T4 may be referred to as a gate initializing transistor for initializing the gate node NG. The fourth transistor T4 may include a gate electrode receiving the initialization signal SI, a source/drain coupled to the gate node NG, and a drain/source coupled to a line of the initialization voltage VINIT. When the initialization signal SI is applied, the fourth transistor T4 may initialize the gate node NG, the capacitor CST, and/or the gate electrode of the first transistor T1 using the initialization voltage VINIT.

The fifth transistor T5 may couple the line of the first power supply voltage ELVDD to the source of the first transistor T1 in response to an emission signal SEM, and the sixth transistor T6 may couple the drain of the first transistor T1 to an anode of the organic light emitting diode EL in response to the emission signal SEM. The fifth and sixth transistors T5 and T6 may be referred to as emission transistors for allowing the organic light emitting diode EL to emit light. The fifth transistor T5 may include a gate electrode receiving the emission signal SEM, a source coupled to the line of the first power supply voltage ELVDD, and a drain coupled to the source of the first transistor T1. The sixth transistor T6 may include a gate electrode receiving the emission signal SEM, a source coupled to the drain of the first transistor T1, and a drain coupled to the anode of the organic light emitting diode EL. When the emission signal SEM is applied, the fifth and sixth transistors T5 and T6 may be turned on, and a path of the driving current from the line of the first power supply voltage ELVDD to a line of a second power supply voltage ELVSS may be formed.

The seventh transistor T7 may transfer the initialization voltage VINIT to the anode of the organic light emitting diode EL in response to (a second instance of) the initialization signal SI. The seventh transistor T7 may be referred to as a diode initializing transistor for initializing the organic light emitting diode EL. The seventh transistor T7 may include a gate electrode receiving the initialization signal SI, a source/drain coupled to the anode of the organic light emitting diode EL, and a drain/source coupled to the line of the initialization voltage VINIT. When the initialization signal SI is applied, the seventh transistor T7 may initialize the organic light emitting diode EL using the initialization voltage VINIT.

The organic light emitting diode EL may emit light based on the driving current generated/provided by the first transistor T1. The organic light emitting diode EL may include the anode coupled to the drain of the sixth transistor T6, and a cathode coupled to the line of the second power supply voltage ELVSS. When the emission signal SEM is applied, the driving current generated by the first transistor T1 may be provided to the organic light emitting diode EL, and the organic light emitting diode EL may emit light based on the driving current.

To reduce power consumption, the organic light emitting diode display device including the pixel 100 may perform low frequency driving, for example, when a still image is displayed. When the low frequency driving is performed, in at least some frame periods, or in a low frequency hold period, each pixel 100 may not receive the initialization signal SI, the scan signal SS, and the data signal DS and may emit light based on the data signal DS that has been stored in the capacitor CST in a previous frame period. Because of a leakage current of the transistors T1 through T7 of the pixel 100, in particular because of a leakage current of the third and fourth transistors T3 and T4 coupled to the second electrode of the capacitor (through the gate node NG), the data signal DS stored in the capacitor CST (i.e., a voltage of the gate node NG) may be distorted, and thus an image quality of the organic light emitting diode display device may be unsatisfactory.

In order to reduce the leakage current of the third and fourth transistors T3 and T4, as illustrated in FIG. 1, each of the third and fourth transistors T3 and T4 may have a dual transistor structure. For example, the third transistor T3 may include first and second sub-transistors T3-1 and T3-2 that are coupled in series between the gate node NG and the drain of the first transistor T1; the fourth transistor T4 may include third and fourth sub-transistors T4-1 and T4-2 that are coupled in series between the gate node NG and the line of the initialization voltage VINIT. Since the third transistor T3 includes the first and second sub-transistors T3-1 and T3-2, the leakage current of the third transistor T3 between the drain of the first transistor T1 and the gate node NG may be reduced. Since the fourth transistor T4 includes the third and fourth sub-transistors T4-1 and T4-2, the leakage current of the fourth transistor T4 between the line of the initialization voltage VINIT and the gate node NG may be reduced.

However, a parasitic capacitor may be formed between a node NT3 of the third transistor T3 and a scan line transmitting the scan signal SS, and a leakage current of the first sub-transistor T3-1 from the node NT3 of the third transistor T3 to the gate node NG may occur. Further, a parasitic capacitor may be formed between a node NT4 of the fourth transistor T4 and an initialization line transmitting the initialization signal SI, and a leakage current of the third sub-transistor T4-1 from the node NT4 of the fourth transistor T4 to the gate node NG may occur. Accordingly, the voltage of the gate node NG may be increased, such that the driving current of the first transistor T1 may be reduced, and thus luminance of the organic light emitting diode EL may be reduced.

In the pixel 100 of the organic light emitting diode display device, to compensate the voltage distortion of the gate node NG by the leakage currents of the third transistor T3, the fourth transistor T4, the first sub-transistor T3-1 and/or the third sub-transistor T4-1, in the low frequency hold period, an off voltage level (e.g., a high voltage level) of at least one of the scan signal SS applied to the third transistor T3 and the initialization signal SI applied to the fourth transistor T4 may be adjusted. In the low frequency hold period, the scan signal SS applied to the third transistor T3 and the initialization signal SI applied to the fourth transistor T4 may have different/unequal off voltage levels. Accordingly, the leakage current to the gate node NG may be compensated or reduced, and thus the voltage distortion of the gate node NG may be compensated.

Figure 2:
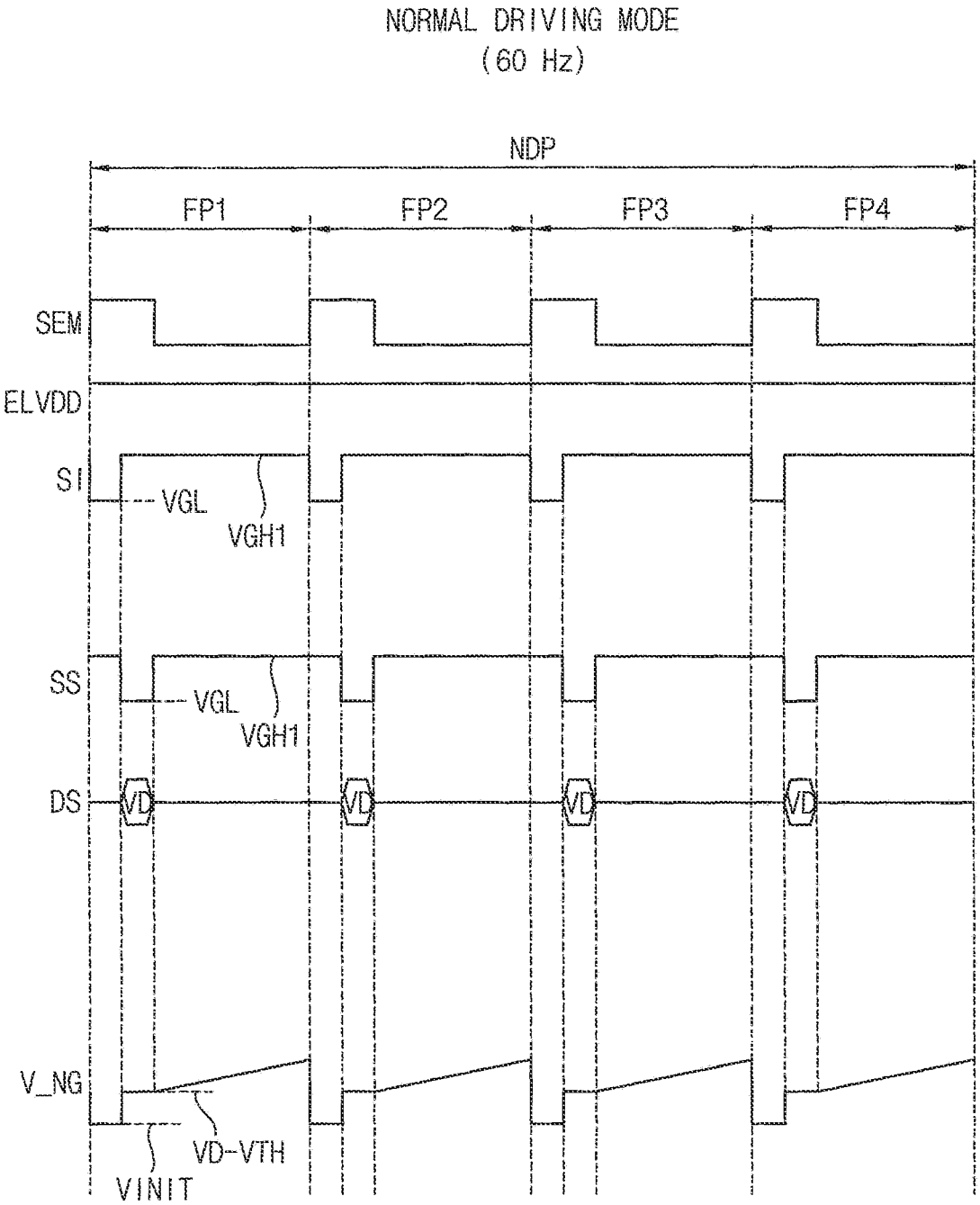
FIG. 2 is a timing diagram for describing an operation of a pixel of an organic light emitting diode display device in a normal driving mode according to embodiments.
Figure 3:
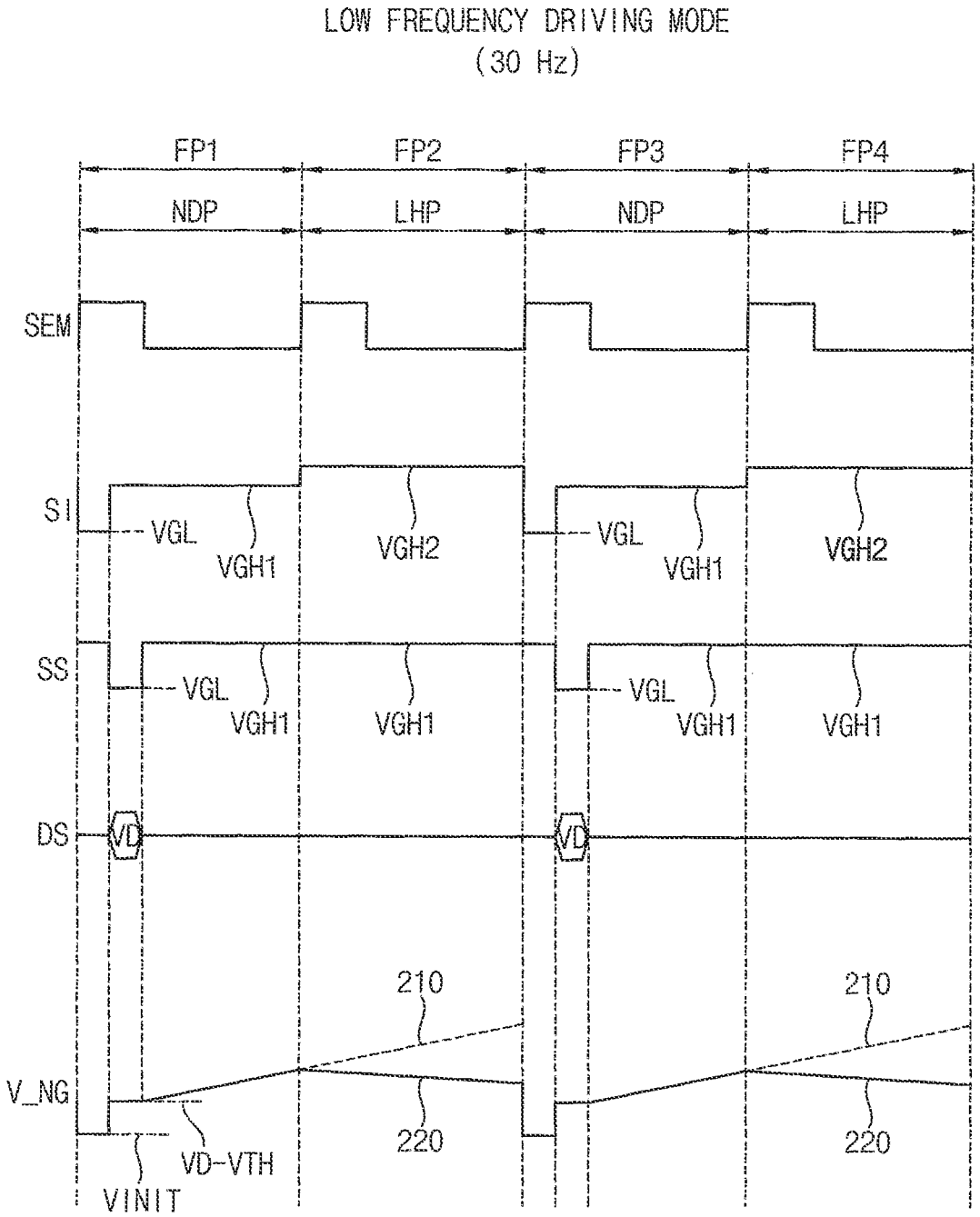
FIG. 3 is a timing diagram for describing an operation of a pixel of an organic light emitting diode display device in a low frequency driving mode according to embodiments.
Figure 4:
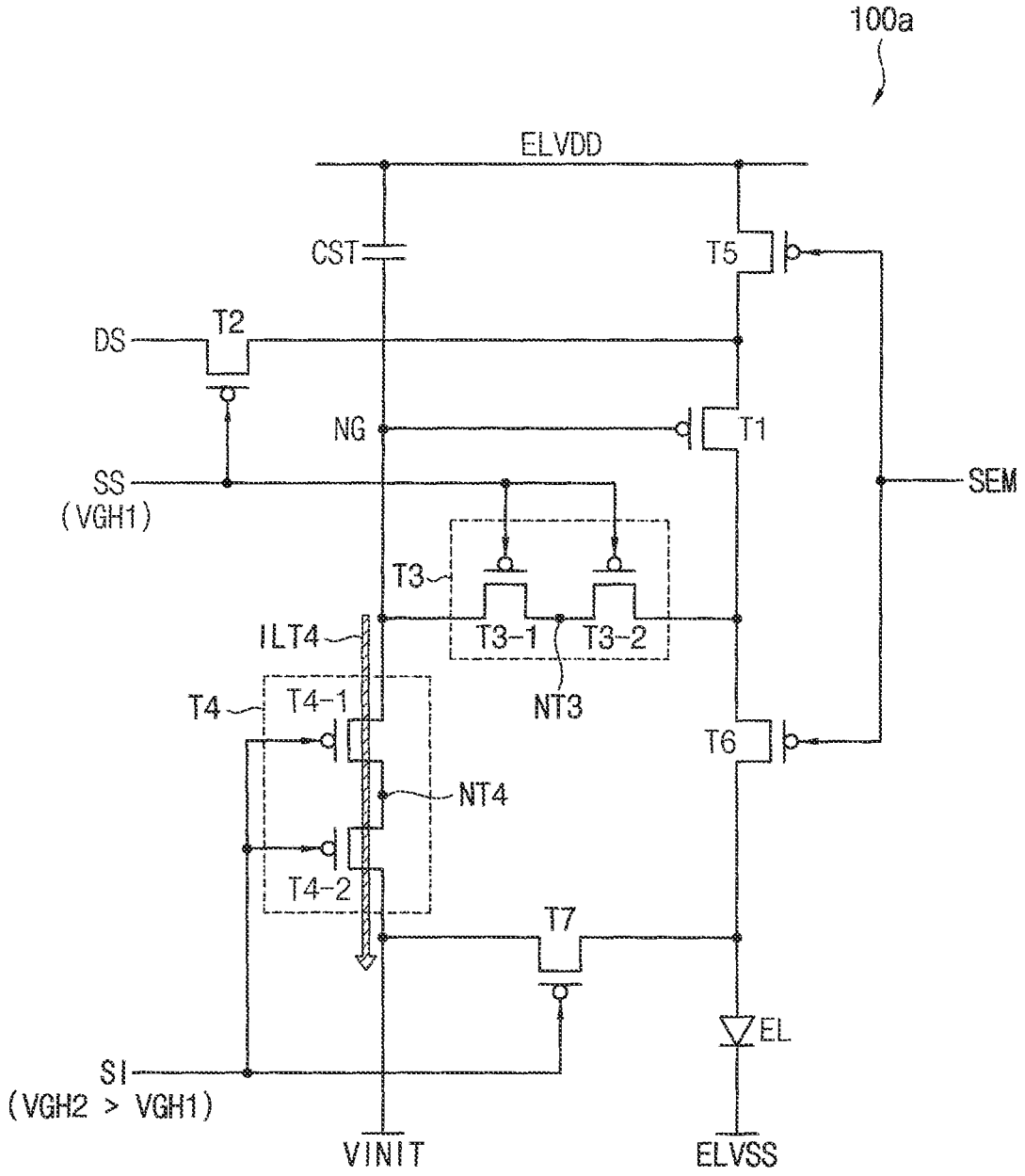
FIG. 4 is a circuit diagram illustrating a pixel of an organic light emitting diode display device in a low frequency driving mode according to embodiments.
Figure 5:
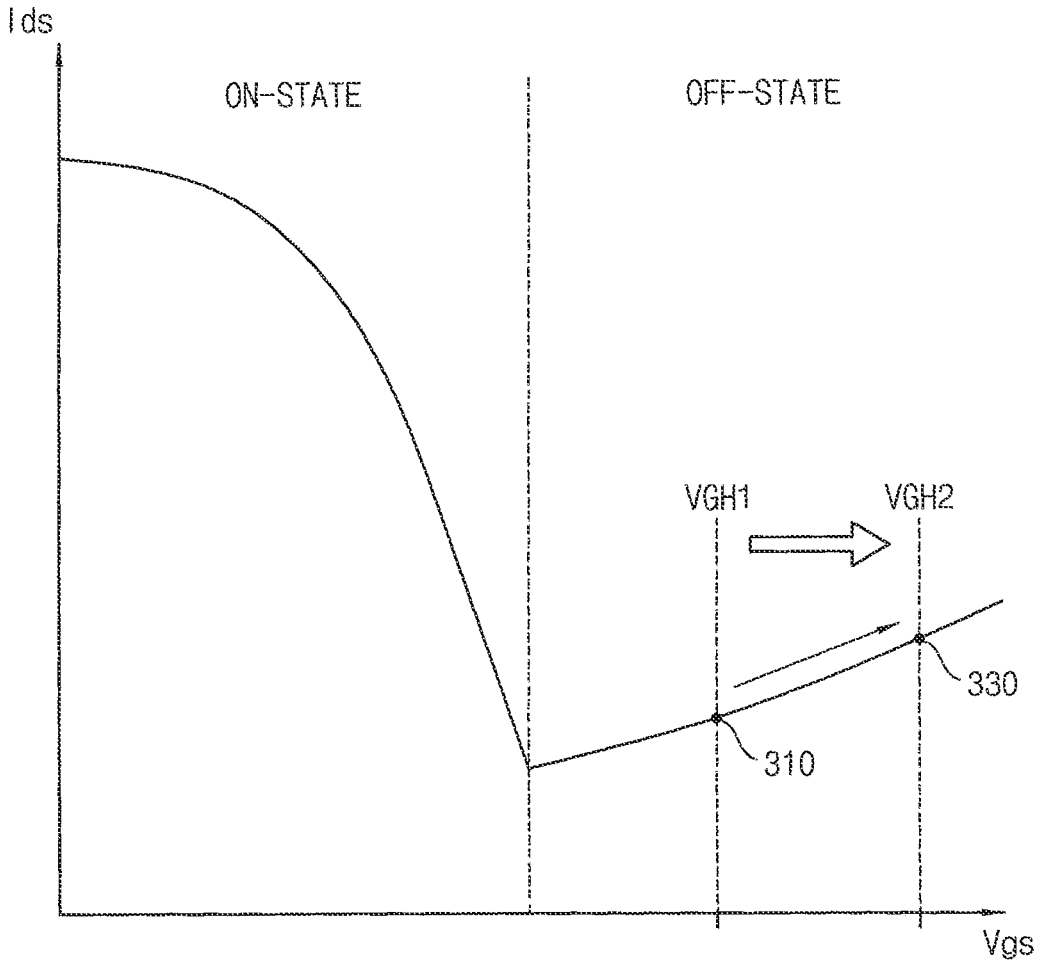
FIG. 5 is a diagram illustrating a voltage-current characteristic of a transistor included in a pixel of an organic light emitting diode display device according to embodiments.
Figure 6:
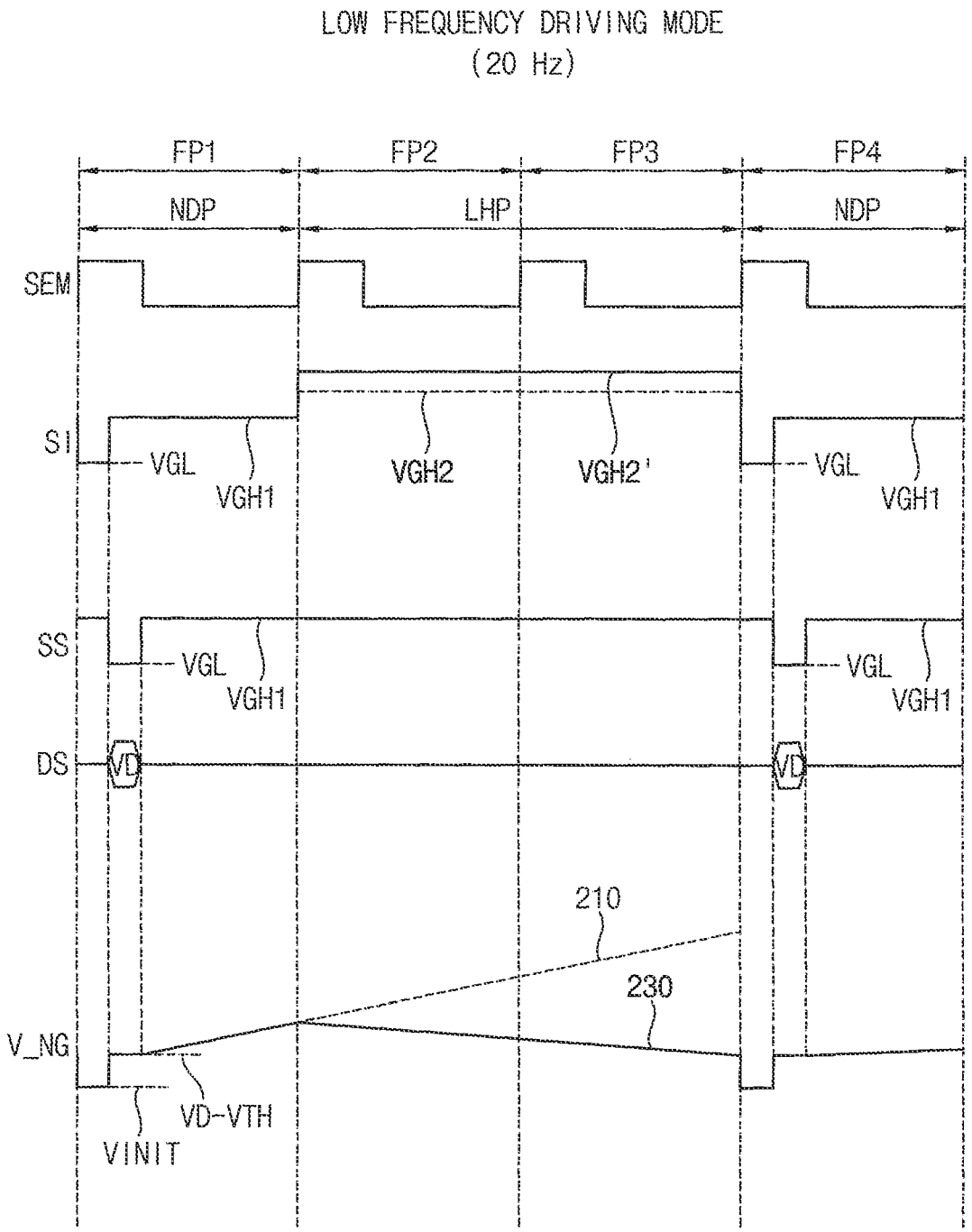
FIG. 6 is a timing diagram for describing an operation of a pixel of an organic light emitting diode display device in a low frequency driving mode according to embodiments.

FIG. 2 is a timing diagram for describing an operation of a pixel of an organic light emitting diode display device in a normal driving mode according to embodiments, FIG. 3 is a timing diagram for describing an operation of a pixel of an organic light emitting diode display device in a low frequency driving mode according to embodiments, FIG. 4 is a circuit diagram illustrating a pixel of an organic light emitting diode display device in a low frequency driving mode according to embodiments, FIG. 5 is a diagram illustrating a voltage-current characteristic of a transistor included in a pixel of an organic light emitting diode display device according to embodiments, and FIG. 6 is a timing diagram for describing an operation of a pixel of an organic light emitting diode display device in a low frequency driving mode according to embodiments.

Referring to FIGS. 1 and 2, in a normal driving mode, a plurality of frame periods FP1, FP2, FP3, and FP4 may be set as a normal driving period NDP, and a display panel of the organic light emitting diode display device may be driven at a normal driving frequency. For example, the normal driving frequency may be about 60 Hz or about 120 Hz.

In each frame period FP1, FP2, FP3, and FP4 of the normal driving period NDP, the scan signal SS and the initialization signal SI may be asynchronous (i.e., having an on voltage level in different times) and may be applied to each pixel PX, and a data voltage VD may be applied as the data signal DS to each pixel PX. A gate on voltage VGL (e.g., a low gate voltage) may be applied as the on voltage level for each of the scan signal SS and the initialization signal SI. For example, as illustrated in FIG. 2, the initialization signal SI having the on voltage level and the scan signal SS having the on voltage level may be sequentially applied to the pixel 100. When the initialization signal SI having the on voltage level is applied, the fourth transistor T4 may be turned on, the initialization voltage VINIT may be applied through the turned-on fourth transistor T4 to the gate node NG, and the gate node NG may have the initialization voltage VINIT as a gate node voltage V_NG. Thereafter, When the scan signal SS having the on voltage level is applied, the second and third transistors T2 and T3 may be turned on, the first transistor T1 may be diode-connected by the turned-on third transistor T3, and the data voltage VD may be applied as the data signal DS to the second electrode of the capacitor CST (or the gate node NG) through the turned-on second transistor T2 and the diode-connected first transistor T1. Accordingly, the gate node voltage V_NG at the gate node NG may be equal to a voltage VD-VTH (i.e., VD minus VTH), a threshold voltage VTH of the first transistor T1 subtracted from the data voltage VD.

Each of the scan signal SS and the initialization signal SI may be changed from the on voltage level to an off voltage level, and the emission signal SEM may be changed to the on voltage level. A first gate off voltage VGH1 (e.g., a first high gate voltage) may be applied as the off voltage level for each of the scan signal SS and the initialization signal SI. When the emission signal SEM having the on voltage level is applied to the pixel 100, the fifth and sixth transistors T5 and T6 may be turned on, the driving current generated by the first transistor T1 may be provided to the organic light emitting diode EL, and the organic light emitting diode EL may emit light based on the driving current. When the organic light emitting diode EL emits light, the leakage current of the third transistor T3 and/or the fourth transistor T4 may flow to the gate node NG, and thus the gate node voltage V_NG may be distorted, or may be gradually increased. However, in the normal driving mode, or in the normal driving period NDP, since each pixel 100 is driven at each and every frame period FP1, FP2, FP3 and FP4, or since the scan signal SS, the initialization signal SI and the data signal DS are applied to each pixel 100 at each and every frame period FP1, FP2, FP3 and FP4, the gate node voltage V_NG may be initialized or refreshed at each and every frame period FP1, FP2, FP3 and FP4. Accordingly, a voltage difference between the gate node voltage V_NG at an emission start time point in each frame period (e.g., FP2) and the gate node voltage V_NG at an emission end time point in a previous frame period (e.g., FP1) may be within a permissible or tolerable voltage difference, a luminance difference between luminance of the pixel 100 at the emission start time point in each frame period (e.g., FP2) and luminance of the pixel 100 at the emission end time point in the previous frame period (e.g., FP1) may be within a permissible or tolerable luminance difference, and thus a flicker caused by the distortion of the gate node voltage V_NG may not significantly affect image display quality. However, a significant flicker may occur in a low frequency driving mode in a conventional organic light emitting diode display device.

Referring to FIGS. 1 and 3, in the low frequency driving mode, at least one (e.g., FP2) of consecutive frame periods (e.g., FP1, FP2) may be set as a low frequency hold period LHP, the remaining frame period (e.g., FP1) may be set as the normal driving period NDP, and thus the display panel may be driven at a low frequency lower than the normal driving frequency. The number of frame periods (e.g., FP2) set as the low frequency hold periods LHP among consecutive frame periods (e.g., FP1, FP2) may be determined according to the low frequency. For example, if the normal driving frequency is N Hz, and if the low frequency is M Hz, where M is an integer less than N, M frame periods among N consecutive frame periods may be set as the low frequency hold periods LHP. Although FIG. 3 illustrates that the normal driving frequency is about 60 Hz and that the low frequency is about 30 Hz, the low frequency in the low frequency driving mode may be frequency lower than the normal driving frequency and unequal to 30 Hz.

In each of frame periods FP1 and FP3, a normal driving period NDP when the display panel is driven, the scan signal SS and the initialization signal SI may be applied to each pixel PX, the data voltage VD may be applied as the data signal DS to each pixel PX, and each pixel PX may emit light based on the applied data voltage VD. In each low frequency hold period LHP, the display panel may not be driven. That the display panel is not driven may mean that the on voltage level of the scan signal SS, the on voltage level of the initialization signal SI, and the data voltage VD are applied to no pixels 100 of the display panel. In the low frequency hold period LHP, each pixel 100 may not receive the on voltage level of the scan signal SS, the on voltage level of the initialization signal SI, and the data voltage VD, and may emit light based on the data signal DS that has been stored in the capacitor CST in a previous frame period.

In a conventional organic light emitting diode display device, the on voltage level of the scan signal SS, the on voltage level of the initialization signal SI, and the data voltage VD are not applied to any pixel 100 in the low frequency hold period LHP. Referring to 210 in FIG. 3, the leakage current of the third transistor T3 and/or the fourth transistor T4 may flow to the gate node NG, and thus the gate node voltage V_NG may be distorted, or may be gradually increased. Accordingly, a voltage difference between the gate node voltage V_NG at an emission start time point in the normal driving period NDP directly after the low frequency hold period LHP and the gate node voltage V_NG at an emission end time point in the low frequency hold period LHP may be greater than the permissible or tolerable voltage difference, a luminance difference between luminance of the pixel 100 at the emission start time point in the normal driving period NDP directly after the low frequency hold period LHP and luminance of the pixel 100 at the emission end time point in the low frequency hold period LHP may be greater than the permissible or tolerable luminance difference, and thus a significant flicker of an image may occur because of this luminance difference. That is, in the conventional organic light emitting diode display device, a significant flicker may be caused by the distortion 210 of the gate node voltage V_NG in the low frequency driving mode.

To reduce or prevent this flicker, in an organic light emitting diode display device according to embodiments, in a low frequency hold period LDP, the scan signal SS applied to the third transistor T3 may have a first off voltage level, and the initialization signal SI applied to the fourth transistor T4 may have a second off voltage level that is different from the first off voltage level. As illustrated in FIG. 3, the initialization signal SI may be increased to the second off voltage level higher than the first off voltage level in the low frequency hold period LDP.

For example, as illustrated in FIG. 3, in a normal driving period NDP when the display panel is driven, the scan signal SS and the initialization signal SI may have the on voltage level in different times, and each of the scan signal SS and the initialization signal SI may be changed to a third off voltage level after the on voltage level. The on voltage level of the scan signal SS and the initialization signal SI in the normal driving period NDP may be a voltage level of the gate on voltage VGL (e.g., the low gate voltage), and the third off voltage level of the scan signal SS and the initialization signal SI in the normal driving period NDP may be a voltage level of the first gate off voltage VGH1 (e.g., the first high gate voltage). In a low frequency hold period LHP, the scan signal SS applied to the third transistor T3 may have the first off voltage level substantially the same as the third off voltage level. That is, the first off voltage level of the scan signal SS in the low frequency hold period LHP may be the voltage level of the first gate off voltage VGH1. Further, in the low frequency hold period LHP, the initialization signal SI applied to the fourth transistor T4 may be increased from the third off voltage level to the second off voltage level higher than the third off voltage level. The second off voltage level of the initialization signal SI in the low frequency hold period LHP may be a voltage level of a second gate off voltage VGH2 (e.g., a second high gate voltage) higher than the first gate off voltage VGH1.

Thus, in the low frequency hold period LHP, as illustrated in FIG. 4, the scan signal SS having the voltage level of the first gate off voltage VGH1 and the initialization signal SI having the voltage level of the second gate off voltage VGH2 higher than the first gate off voltage VGH1 may be applied to the pixel 100*a* of the organic light emitting diode display device according to embodiments. As illustrated in FIG. 5, which shows a voltage-current (Vgs-Ids) characteristic of a transistor T4 in an on-state (ON-STATE) and an off-state (OFF-STATE), if the initialization signal SI applied to the fourth transistor T4 is changed from the first gate off voltage VGH1 to the second gate off voltage VGH2 higher than the first gate off voltage VGH1, the voltage-current characteristic of the fourth transistor T4 may be changed from a first operating point 310 to a second operating point 330. Accordingly, the leakage current ILT4 of the fourth transistor T4 from the gate node NG to the line of the initialization voltage VINIT may be increased based on the second off voltage level higher than the third off voltage level, or the voltage level of the second gate off voltage VGH2 higher than the first gate off voltage VGH1. Since the leakage current ILT4 of the fourth transistor T4 from the gate node NG to the line of the initialization voltage VINIT is increased in the low frequency hold period LHP, the distortion 210 of the gate node voltage V_NG may be compensated as indicated by 220 in FIG. 3. That is, as illustrated as 220 in FIG. 3, the gate node voltage V_NG may not be increased, or may be decreased in the low frequency hold period LHP. Accordingly, the voltage difference between the gate node voltage V_NG at the emission start time point in the normal driving period NDP directly after the low frequency hold period LHP and the gate node voltage V_NG at the emission end time point in the low frequency hold period LHP may be within the permissible or tolerable voltage difference, the luminance difference between the luminance of the pixel 100*a* at the emission start time point in the normal driving period NDP directly after the low frequency hold period LHP and the luminance of the pixel 100 at the emission end time point in the low frequency hold period LHP may be within the permissible or tolerable luminance difference, and thus the flicker in the low frequency driving mode may be minimized or prevented.

A difference between the second off voltage level and the third off voltage level, or a voltage level difference between the second gate off voltage VGH2 and the first gate off voltage VGH1 may be determined according to a driving frequency for the display panel or the low frequency. The lower the driving frequency in the low frequency driving mode is, the greater the voltage level difference between the second gate off voltage VGH2 and the first gate off voltage VGH1 is. For example, as illustrated in FIGS. 3 and 6, the second gate off voltage VGH2' in the low frequency hold period LHP in the low frequency driving mode for the display panel driven at about 20 Hz may be higher than the second gate off voltage VGH2 in the low frequency hold period LHP in the low frequency driving mode for the display panel driven at about 30 Hz. Thus, although the distortion of the gate node voltage V_NG at the low frequency of about 20 Hz may be greater than the distortion of the gate node voltage V_NG at the low frequency of about 30 Hz, the second gate off voltage VGH2' NG at the low frequency of about 20 Hz may be higher than the second gate off voltage VGH2 NG at the low frequency of about 30 Hz, and thus the distortion 210 of the gate node voltage V_NG at the low frequency of about 20 Hz may be sufficiently compensated as indicated by 230 in FIG. 6.

Referring to FIG. 3, FIG. 4, FIG. 5, and FIG. 6, in the pixel 100*a* of the organic light emitting diode display device according to embodiments, in a low frequency hold period LHP, the off voltage level of the initialization signal SI applied to the fourth transistor T4 may be increased. Accordingly, the leakage current ILT4 of the fourth transistor T4 from the gate node NG may be increased, the distortion 210 of the gate node voltage V_NG at low frequency driving may be compensated, and thus satisfactory image quality of the organic light emitting diode display device may be attained.

Figure 7:
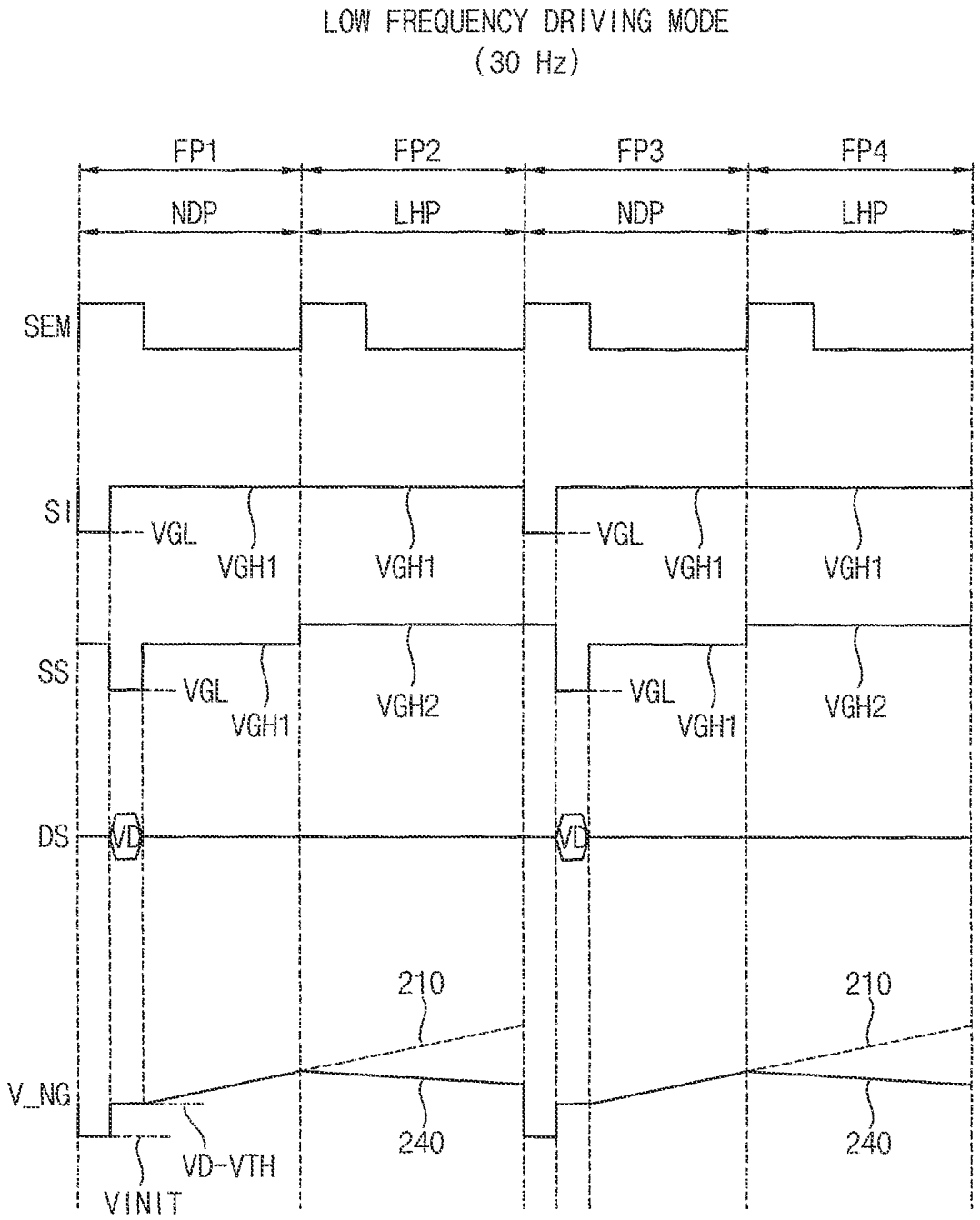
FIG. 7 is a timing diagram for describing an operation of a pixel of an organic light emitting diode display device in a low frequency driving mode according to embodiments.
Figure 8:
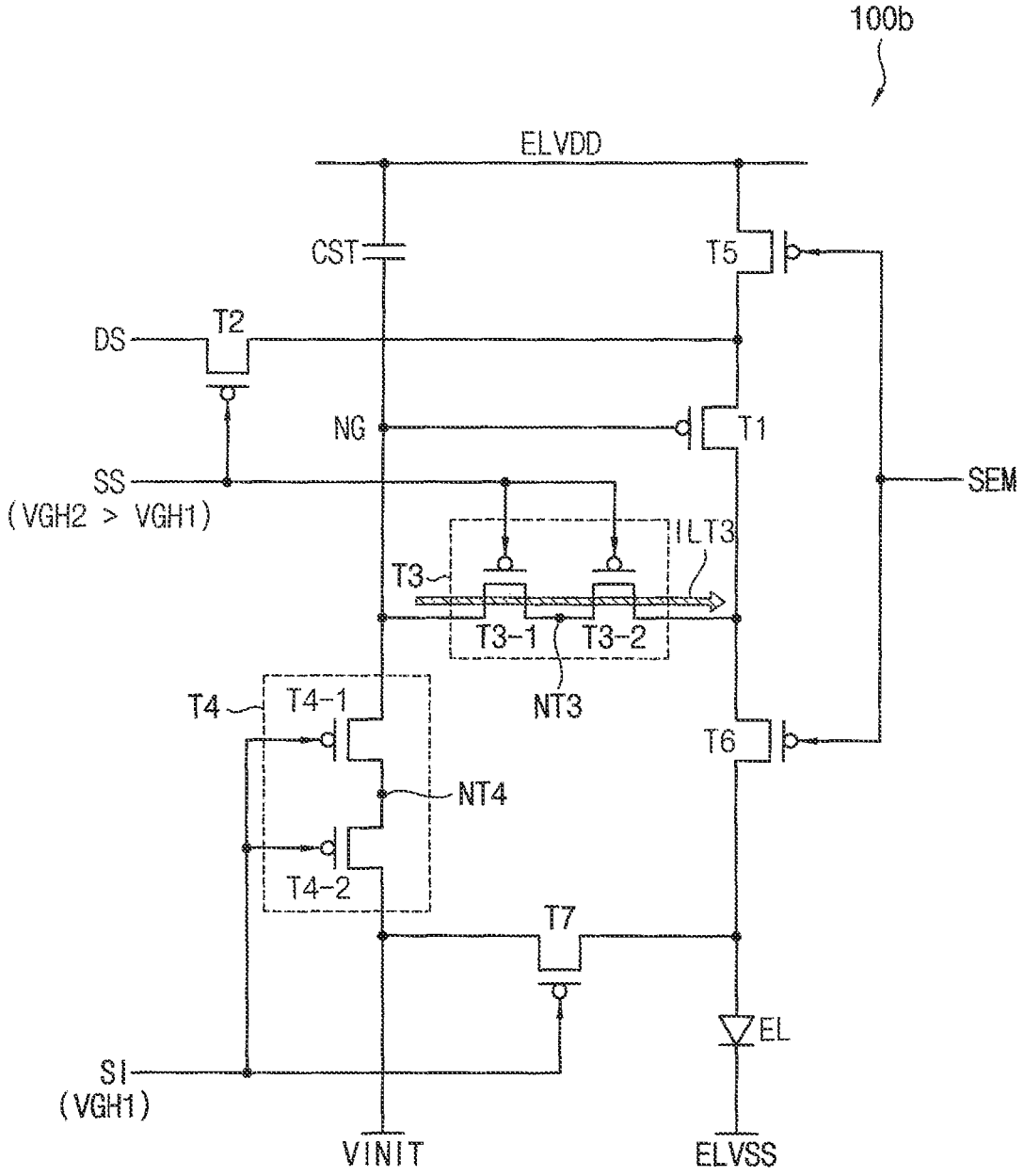
FIG. 8 is a circuit diagram illustrating a pixel of an organic light emitting diode display device in a low frequency driving mode according to embodiments.

FIG. 7 is a timing diagram for describing an operation of a pixel of an organic light emitting diode display device in a low frequency driving mode according to embodiments, and FIG. 8 is a circuit diagram illustrating a pixel of an organic light emitting diode display device in a low frequency driving mode according to embodiments.

Referring to FIGS. 7 and 8, in a low frequency hold period LHP, a scan signal SS having a voltage level of a second gate off voltage VGH2 higher than a first gate off voltage VGH1 and an initialization signal SI having a voltage level of the first gate off voltage VGH1 may be applied to a pixel 100*b* of an organic light emitting diode display device. In the low frequency hold period LHP, a leakage current ILT3 of a third transistor T3 from a gate node NG to a drain of a first transistor T1 may be increased based on the scan signal SS having the voltage level of the second gate off voltage VGH2 higher than the first gate off voltage VGH1. Accordingly, since the leakage current ILT3 of the third transistor T3 from the gate node NG to the drain of the first transistor T1 is increased in the low frequency hold period LHP, a distortion 210 of a gate node voltage V_NG may be compensated as indicated by 240 in FIG. 7. That is, as illustrated as 240 in FIG. 7, the gate node voltage V_NG may not be increased, or may be decreased in the low frequency hold period LHP, and thus a flicker in a low frequency driving mode may be minimized or prevented.

In the pixel 100*b*, in the low frequency hold period LHP, the off voltage level of the scan signal SS applied to the third transistor T3 may be increased. Accordingly, the leakage current ILT3 of the third transistor T3 from the gate node NG may be increased, the distortion 210 of the gate node voltage V_NG at low frequency driving may be compensated, and thus satisfactory image quality of the organic light emitting diode display device may be attained.

Figure 9:
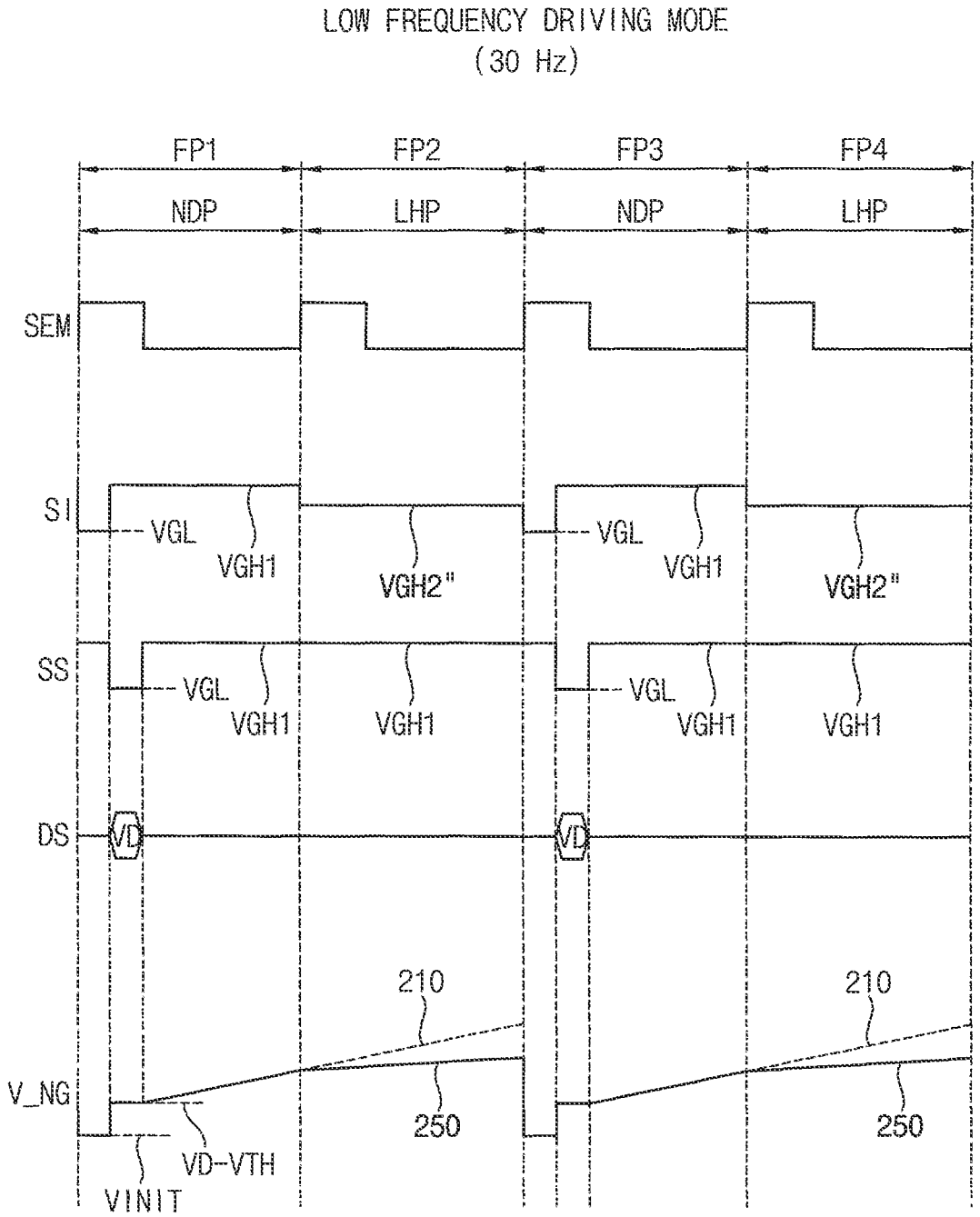
FIG. 9 is a timing diagram for describing an operation of a pixel of an organic light emitting diode display device in a low frequency driving mode according to embodiments.
Figure 10:
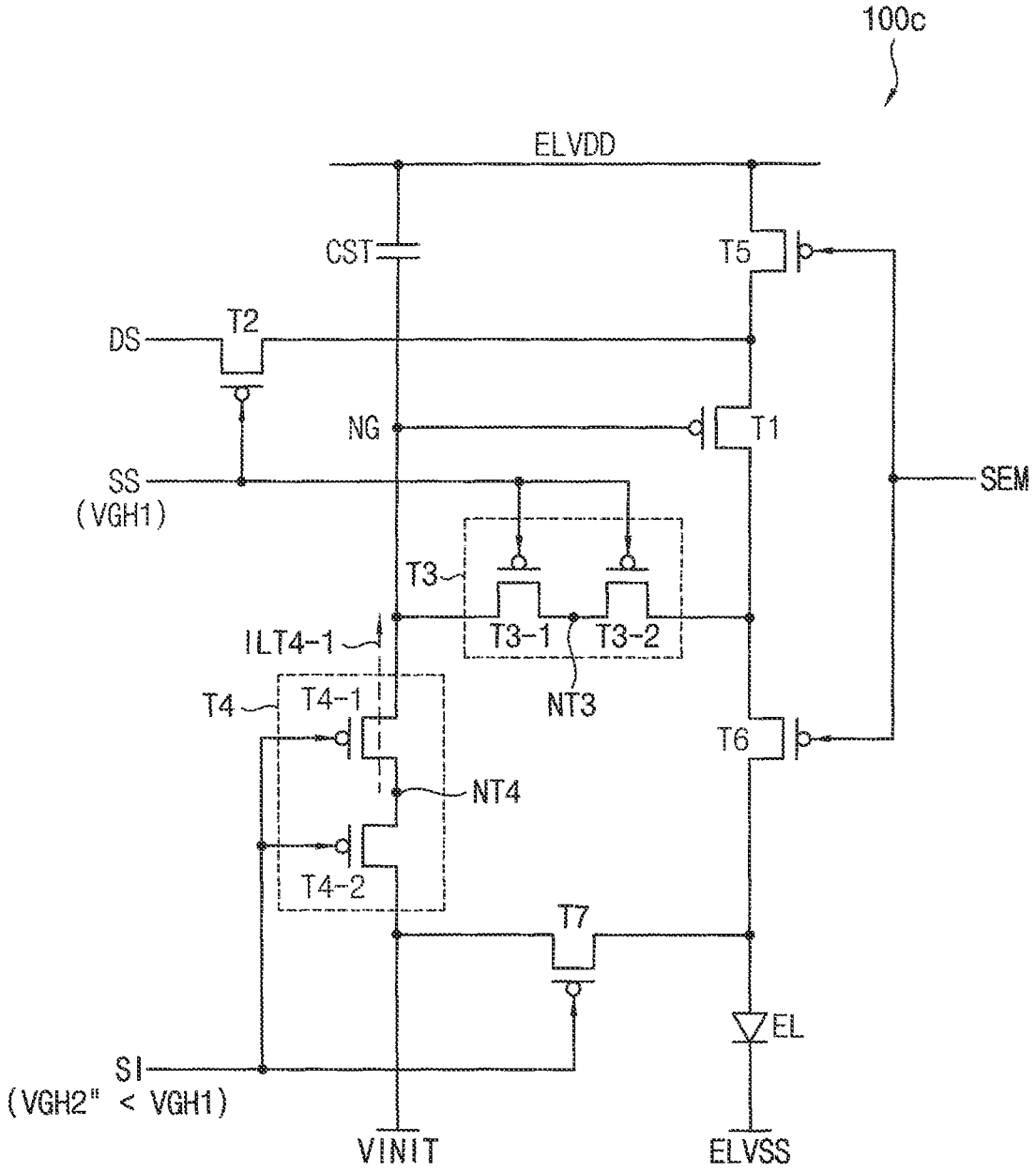
FIG. 10 is a circuit diagram illustrating a pixel of an organic light emitting diode display device in a low frequency driving mode according to embodiments.
Figure 11:
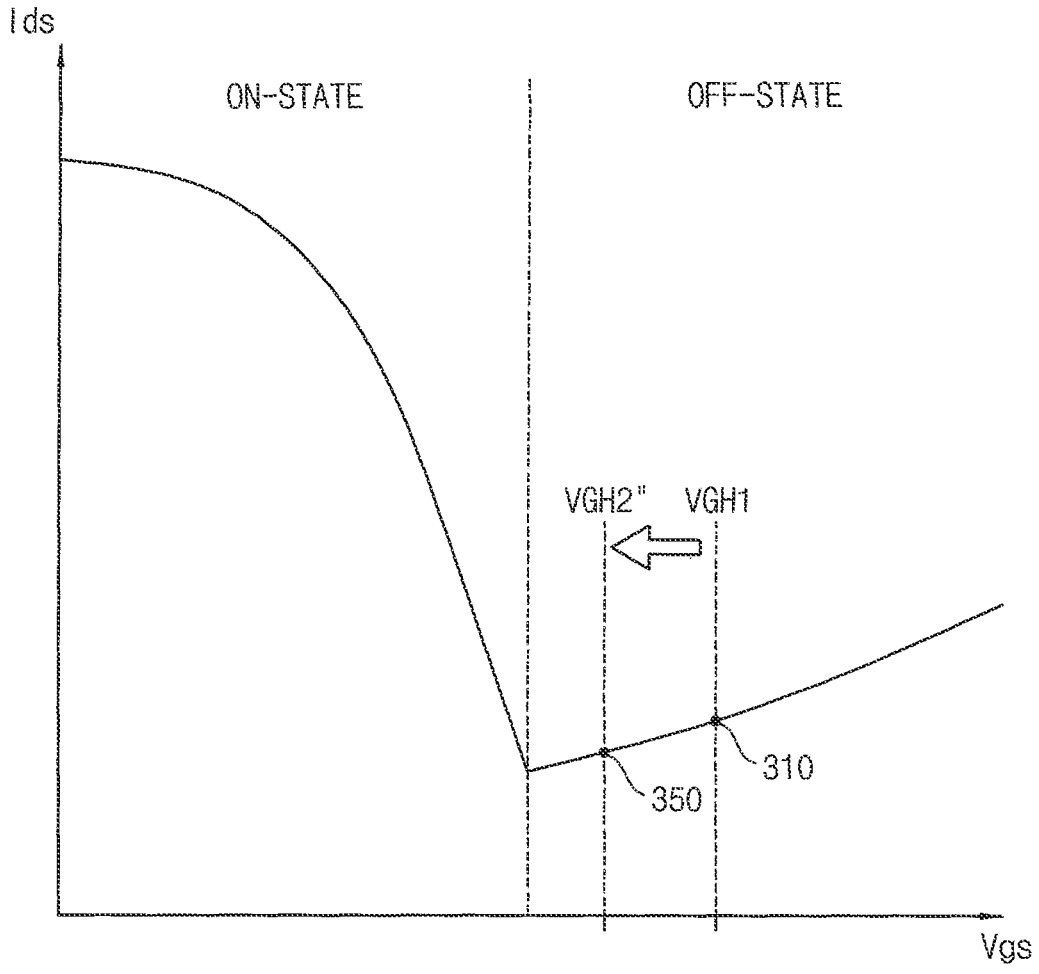
FIG. 11 is a diagram illustrating a voltage-current characteristic of a transistor included in a pixel of an organic light emitting diode display device according to embodiments.

FIG. 9 is a timing diagram for describing an operation of a pixel of an organic light emitting diode display device in a low frequency driving mode according to embodiments, FIG. 10 is a circuit diagram illustrating a pixel of an organic light emitting diode display device in a low frequency driving mode according to embodiments, and FIG. 11 is a diagram illustrating a voltage-current characteristic of a transistor included in a pixel of an organic light emitting diode display device according to embodiments.

Referring to FIGS. 9 and 10, in a low frequency hold period LHP, a scan signal SS having a voltage level of a first gate off voltage VGH1 and an initialization signal SI having a voltage level of a second gate off voltage VGH2" lower than the first gate off voltage VGH1 may be applied to a pixel 100*c* of an organic light emitting diode display device according to embodiments. If the initialization signal SI applied to a fourth transistor T4 is changed from the first gate off voltage VGH1 to the second gate off voltage VGH2" lower than the first gate off voltage VGH1, as illustrated in FIG. 11, a voltage-current characteristic of the fourth transistor T4, or voltage-current characteristics of third and fourth sub-transistors T4-1 and T4-2, may be changed from a first operating point 310 to a second operating point 350. Accordingly, a leakage current ILT4-1 of the fourth transistor T4, or in particular a leakage current ILT4-1 of the third sub-transistor T4-1, from a node NT4 of the fourth transistor T4 to a gate node NG may be decreased based on the initialization signal SI having the voltage level of the second gate off voltage VGH2" lower than the first gate off voltage VGH1. Accordingly, since the leakage current ILT4-1 of the fourth transistor T4, or in particular the leakage current ILT4-1 of the third sub-transistor T4-1, to the gate node NG is decreased in the low frequency hold period LHP, a distortion 210 of a gate node voltage V_NG may be compensated as indicated by 250 in FIG. 9. That is, as indicated by 250 in FIG. 9, an increment of the gate node voltage V_NG in the low frequency hold period LHP may be reduced, and thus a flicker in a low frequency driving mode may be minimized or prevented.

In the pixel 100*c*, in the low frequency hold period LHP, the off voltage level of the initialization signal SI applied to the fourth transistor T4 may be decreased. Accordingly, the leakage current ILT4-1 of the fourth transistor T4 to the gate node NG may be decreased, the distortion 210 of the gate node voltage V_NG at low frequency driving may be compensated, and thus satisfactory image quality of the organic light emitting diode display device may be attained.

Figure 12:
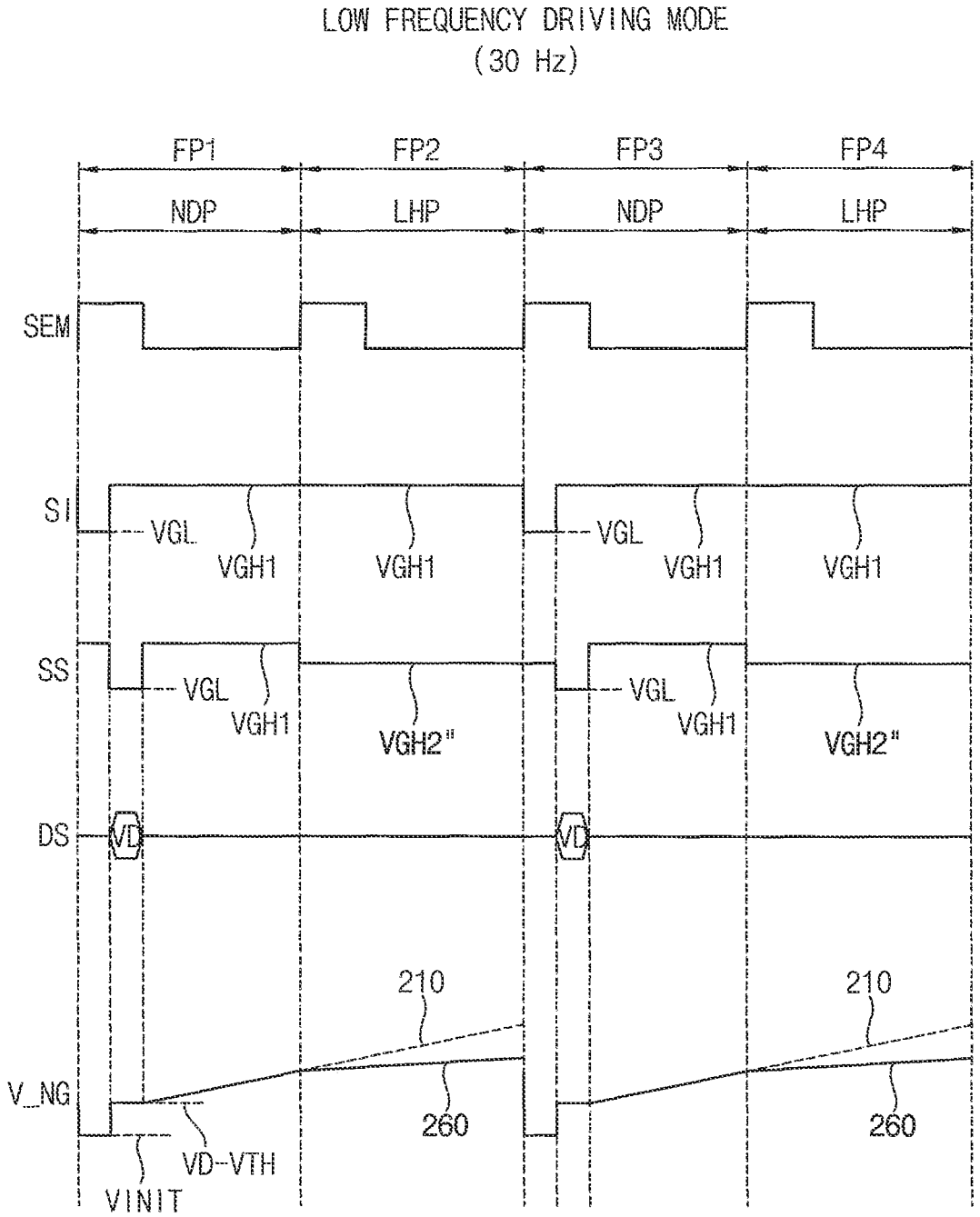
FIG. 12 is a timing diagram for describing an operation of a pixel of an organic light emitting diode display device in a low frequency driving mode according to embodiments.
Figure 13:
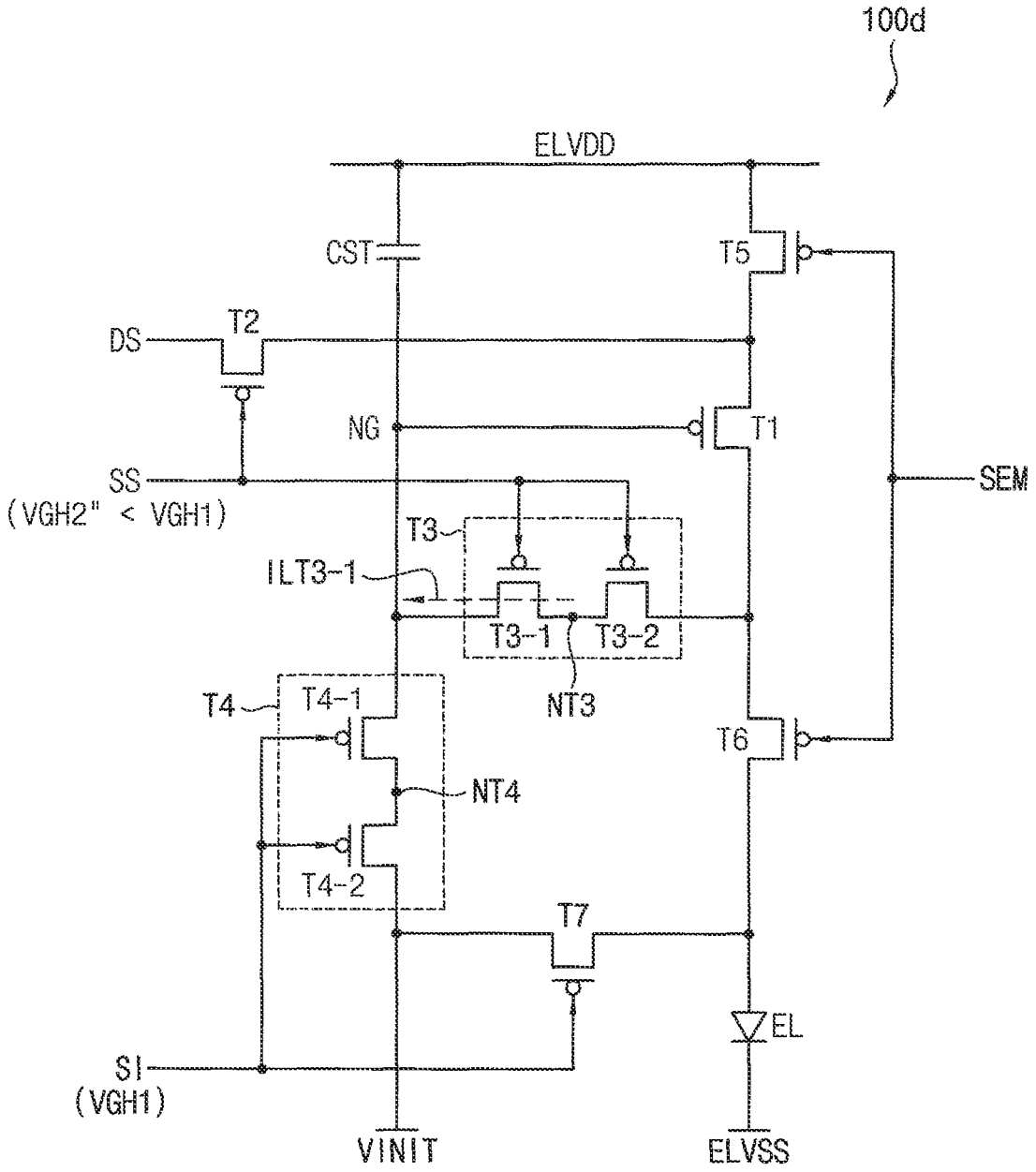
FIG. 13 is a circuit diagram illustrating a pixel of an organic light emitting diode display device in a low frequency driving mode according to embodiments.

FIG. 12 is a timing diagram for describing an operation of a pixel of an organic light emitting diode display device in a low frequency driving mode according to embodiments, and FIG. 13 is a circuit diagram illustrating a pixel of an organic light emitting diode display device in a low frequency driving mode according to embodiments.

Referring to FIGS. 12 and 13, in a low frequency hold period LHP, a scan signal SS having a voltage level of a second gate off voltage VGH2" lower than a first gate off voltage VGH1 and an initialization signal SI having a voltage level of the first gate off voltage VGH1 may be applied to a pixel 100*d* of an organic light emitting diode display device. A leakage current ILT3-1 of a first sub-transistor T3-1 from a node NT3 of a third transistor T3 to a gate node NG may be decreased based on the scan signal SS having the voltage level of the second gate off voltage VGH2" lower than the first gate off voltage VGH1. Accordingly, since the leakage current ILT3-1 of the first sub-transistor T3-1 to the gate node NG is decreased in the low frequency hold period LHP, a distortion 210 of a gate node voltage V_NG may be compensated as indicated by 260 in FIG. 12. That is, as indicated by 260 in FIG. 12, the gate node voltage V_NG in the low frequency hold period LHP may not significantly increase, and thus a flicker in a low frequency driving mode may be minimized or prevented.

In the pixel 100*d*, in the low frequency hold period LHP, the off voltage level of the scan signal SS applied to the third transistor T3 may be decreased. Accordingly, the leakage current ILT3-1 of the third transistor T3 to the gate node NG may be decreased, the distortion 210 of the gate node voltage V_NG at low frequency driving may be compensated, and thus satisfactory image quality of the organic light emitting diode display device may be attained.

Figure 14:
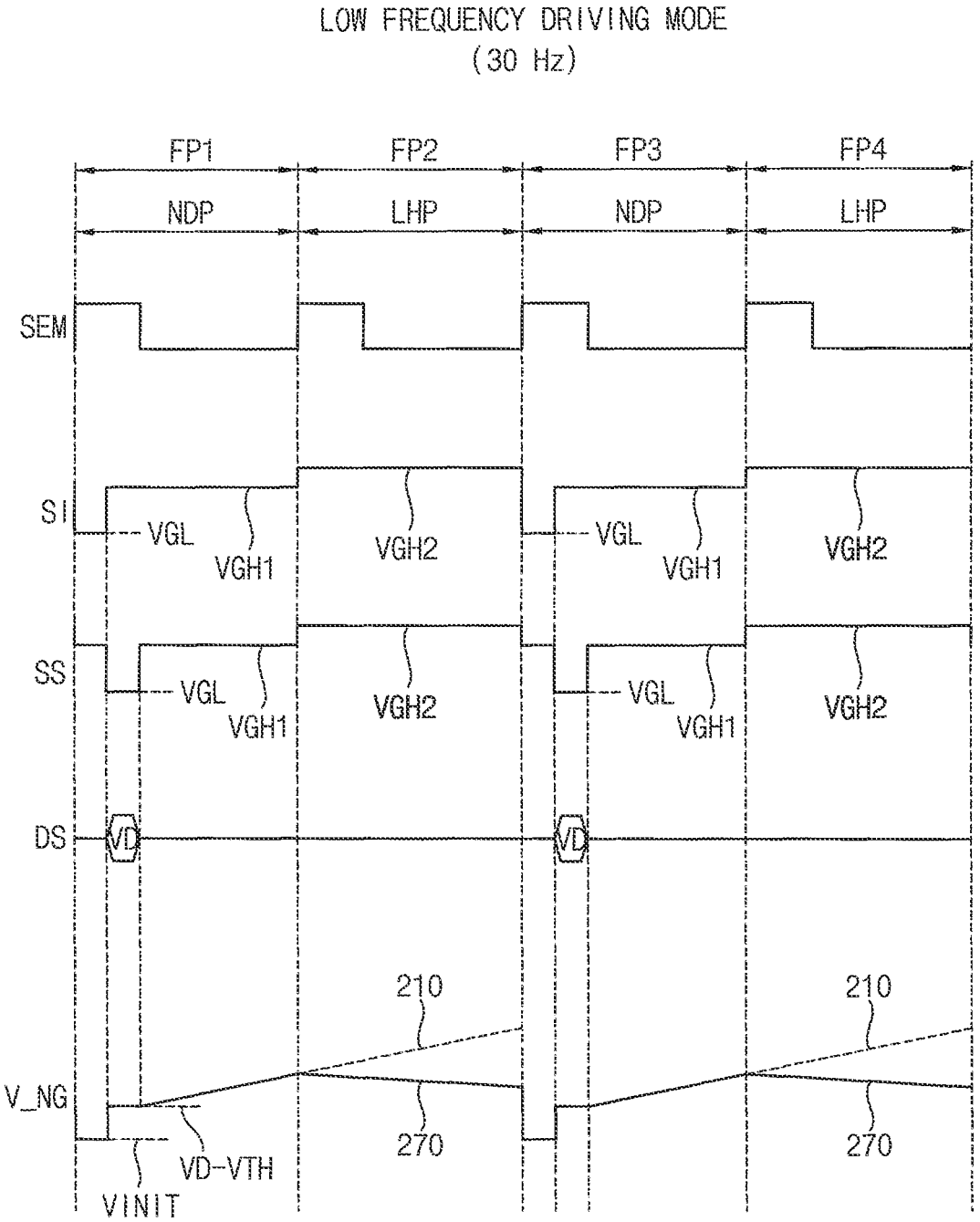
FIG. 14 is a timing diagram for describing an operation of a pixel of an organic light emitting diode display device in a low frequency driving mode according to embodiments.
Figure 15:
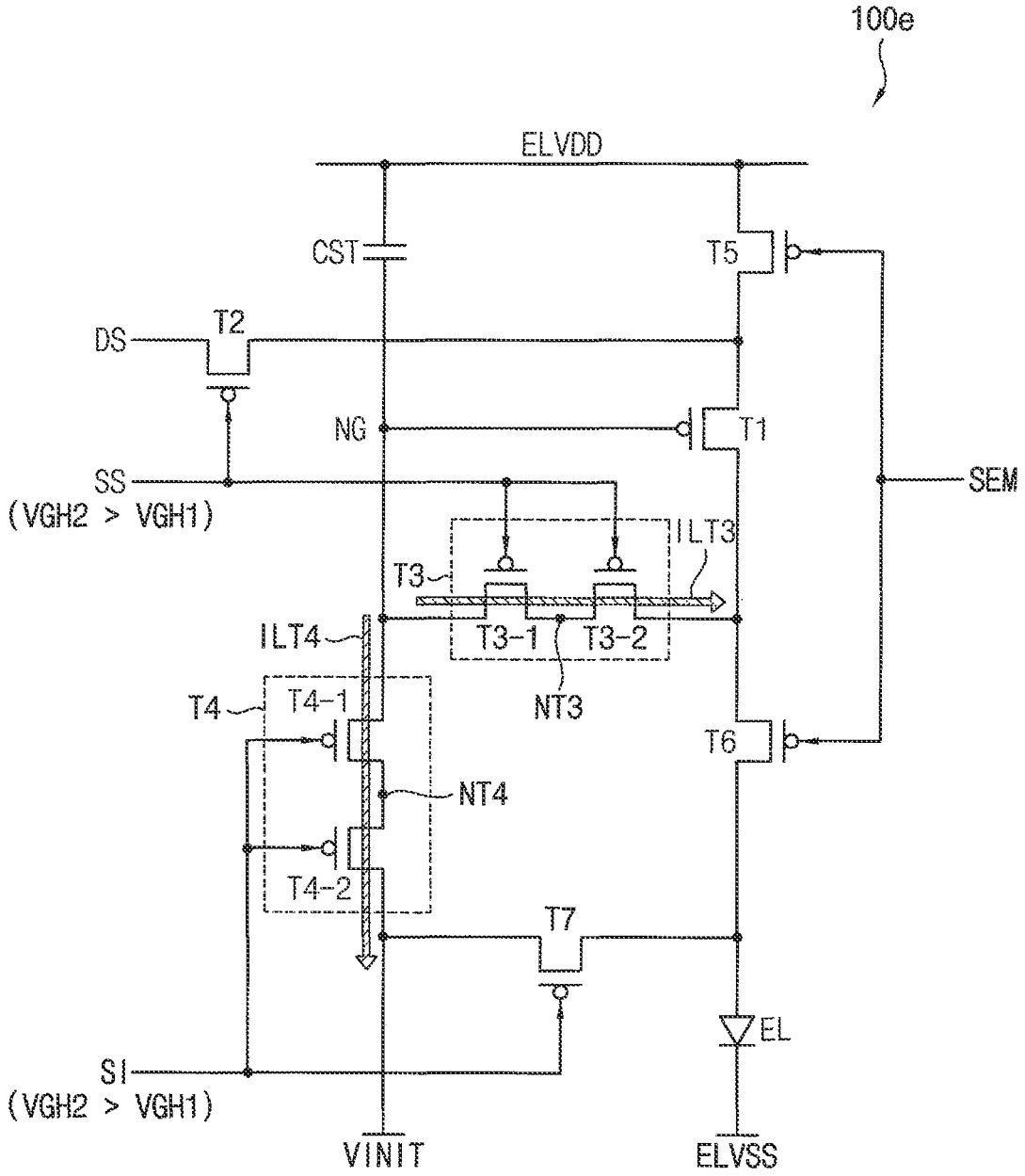
FIG. 15 is a circuit diagram illustrating a pixel of an organic light emitting diode display device in a low frequency driving mode according to embodiments.

FIG. 14 is a timing diagram for describing an operation of a pixel of an organic light emitting diode display device in a low frequency driving mode according to embodiments, and FIG. 15 is a circuit diagram illustrating a pixel of an organic light emitting diode display device in a low frequency driving mode according to embodiments.

Referring to FIGS. 14 and 15, in a low frequency hold period LHP, a scan signal SS having a voltage level of a second gate off voltage VGH2 higher than a first gate off voltage VGH1 and an initialization signal SI having the voltage level of the second gate off voltage VGH2 higher than the first gate off voltage VGH1 may be applied to a pixel 100*e* of an organic light emitting diode display device. In the low frequency hold period LHP, a leakage current ILT3 of a third transistor T3 from a gate node NG to a drain of a first transistor T1 may be increased based on the scan signal SS having the voltage level of the second gate off voltage VGH2 higher than the first gate off voltage VGH1, and a leakage current ILT4 of a fourth transistor T4 from the gate node NG to a line of an initialization voltage VINIT may be increased based on the initialization signal SI having the voltage level of the second gate off voltage VGH2 higher than the first gate off voltage VGH1. Accordingly, since the leakage currents ILT3 and ILT4 of the third and fourth transistors T3 and T4 from the gate node NG are increased in the low frequency hold period LHP, a distortion 210 of a gate node voltage V_NG may be compensated as indicated by 270 in FIG. 14. That is, as indicated by 270 in FIG. 14, the gate node voltage V_NG may not be increased, or may be decreased in the low frequency hold period LHP, and thus a flicker in a low frequency driving mode may be minimized or prevented.

In the pixel 100*e*, in the low frequency hold period LHP, the off voltage level of the scan signal SS applied to the third transistor T3 and the off voltage level of the initialization signal SI applied to the fourth transistor T4 may be increased. Accordingly, the leakage currents ILT3 and ILT4 of the third and fourth transistors T3 and T4 from the gate node NG may be increased, the distortion 210 of the gate node voltage V_NG at low frequency driving may be compensated, and thus satisfactory image quality of the organic light emitting diode display device may be attained.

Figure 16:
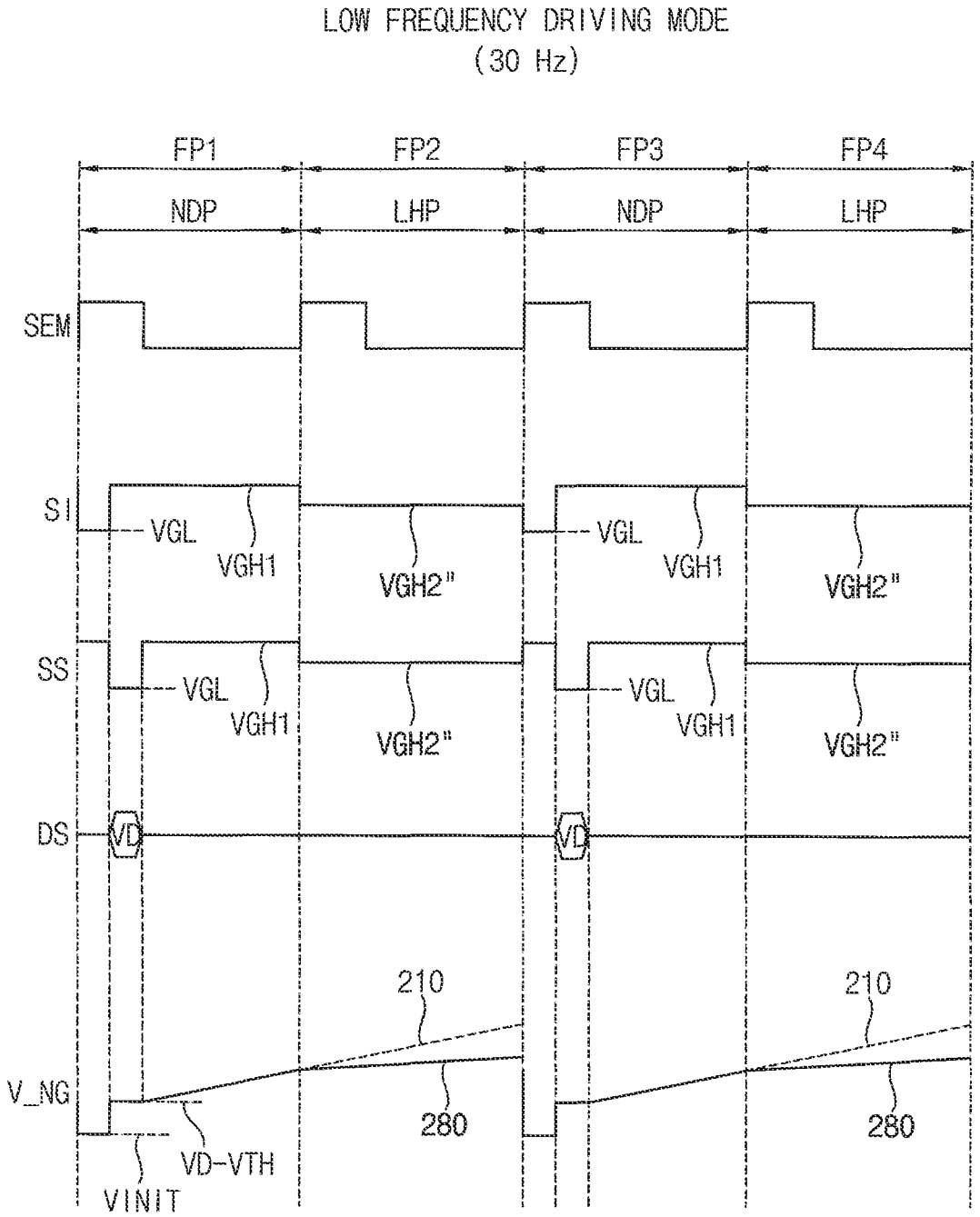
FIG. 16 is a timing diagram for describing an operation of a pixel of an organic light emitting diode display device in a low frequency driving mode according to embodiments.
Figure 17:
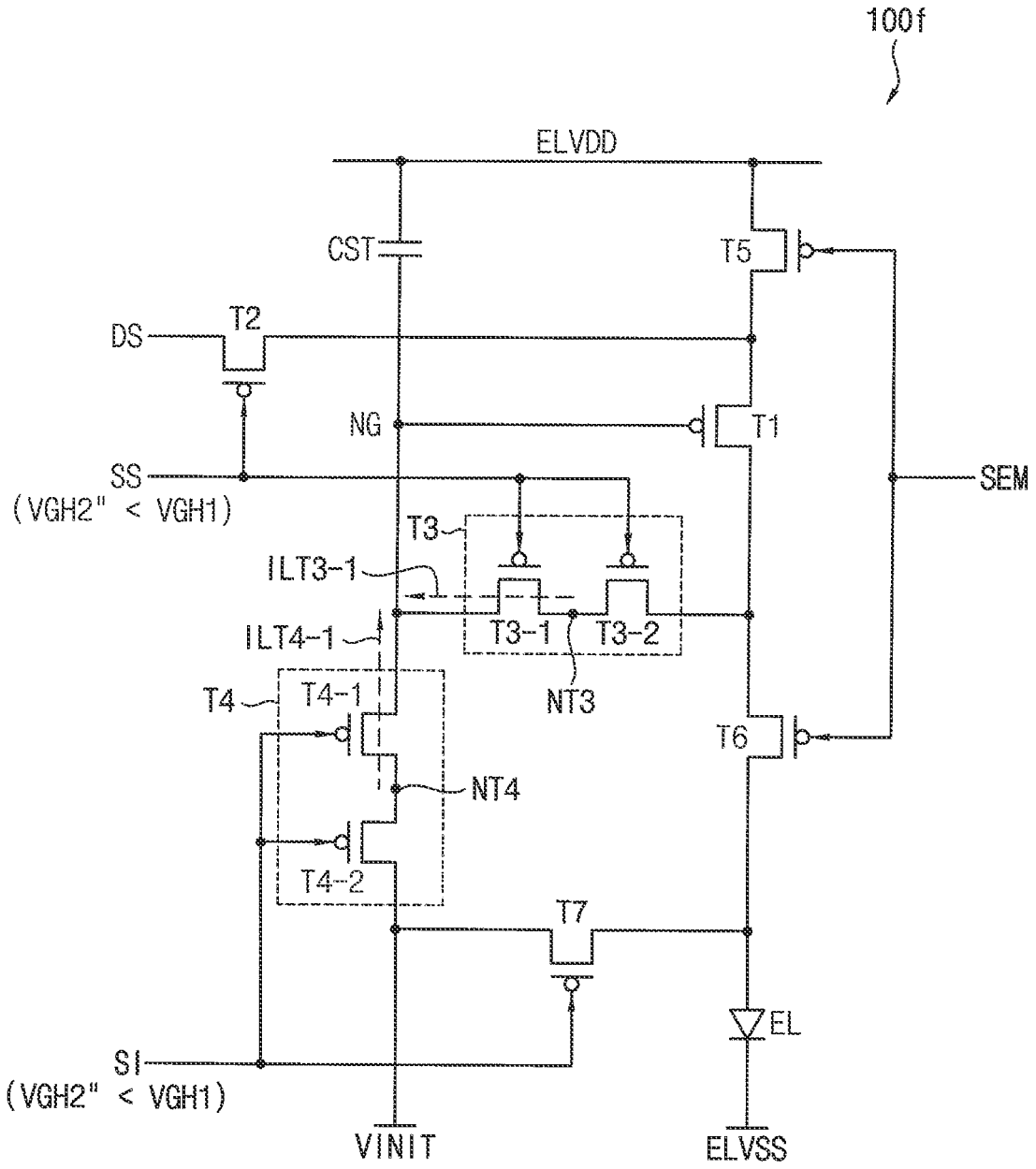
FIG. 17 is a circuit diagram illustrating a pixel of an organic light emitting diode display device in a low frequency driving mode according to embodiments.

FIG. 16 is a timing diagram for describing an operation of a pixel of an organic light emitting diode display device in a low frequency driving mode according to embodiments, and FIG. 17 is a circuit diagram illustrating a pixel of an organic light emitting diode display device in a low frequency driving mode according to embodiments.

Referring to FIGS. 16 and 17, in a low frequency hold period LHP, a scan signal SS having a voltage level of a second gate off voltage VGH2" lower than a first gate off voltage VGH1 and an initialization signal SI having the voltage level of the second gate off voltage VGH2" lower than the first gate off voltage VGH1 may be applied to a pixel 100*f* of an organic light emitting diode display device. A leakage current ILT3-1 of a first sub-transistor T3-1 from a node NT3 of a third transistor T3 to a gate node NG may be decreased based on the scan signal SS having the voltage level of the second gate off voltage VGH2" lower than the first gate off voltage VGH1, and a leakage current ILT4-1 of a third sub-transistor T4-1 from a node NT4 of a fourth transistor T4 to the gate node NG may be decreased based on the initialization signal SI having the voltage level of the second gate off voltage VGH2" lower than the first gate off voltage VGH1. Accordingly, since the leakage currents ILT3-1 and ILT4-1 of the first and third sub-transistors T3-1 and T4-1 to the gate node NG are decreased in the low frequency hold period LHP, a distortion 210 of a gate node voltage V_NG may be compensated as indicated by 280 in FIG. 16. That is, as indicated by 280 in FIG. 16, an increment of the gate node voltage V_NG in the low frequency hold period LHP may be reduced, and thus a flicker in a low frequency driving mode may be minimized or prevented.

In the pixel 100*f*, in the low frequency hold period LHP, the off voltage level of the scan signal SS applied to the third transistor T3 and the off voltage level of the initialization signal SI applied to the fourth transistor T4 may be decreased. Accordingly, the leakage currents ILT3-1 and ILT4-1 of the first and third sub-transistors T3-1 and T4-1 to the gate node NG may be decreased, the distortion 210 of the gate node voltage V_NG at low frequency driving may be compensated, and thus satisfactory image quality of the organic light emitting diode display device may be attained.

Figure 18:
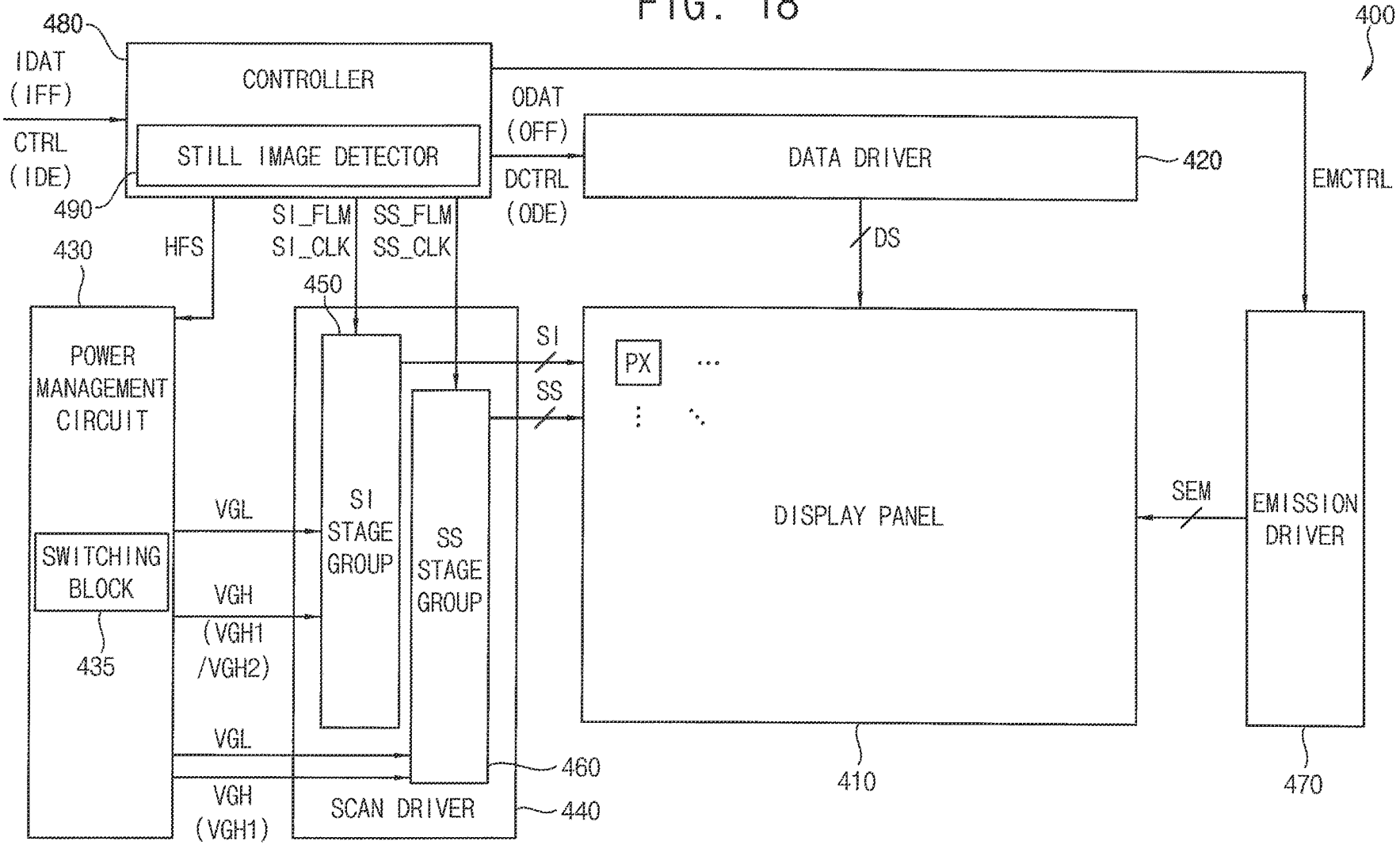
FIG. 18 is a block diagram illustrating an organic light emitting diode display device according to embodiments.
Figure 19:
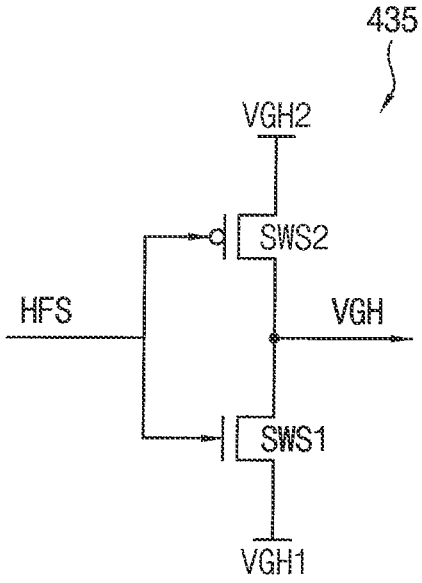
FIG. 19 is a circuit diagram illustrating a switching block included in a power management circuit of an organic light emitting diode display device according to embodiments.
Figure 20:
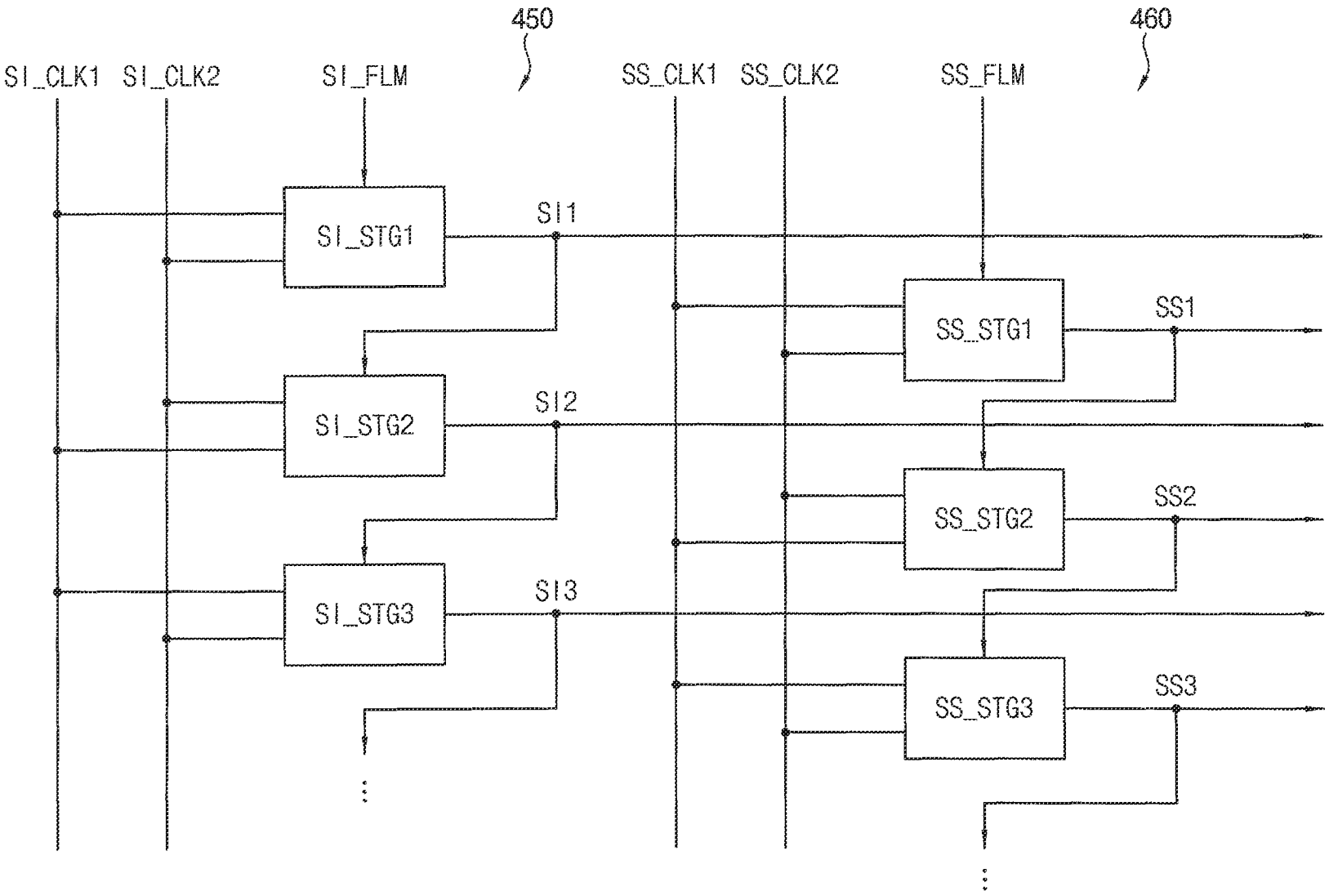
FIG. 20 is a block diagram illustrating a scan driver included in an organic light emitting diode display device according to embodiments.
Figure 21:
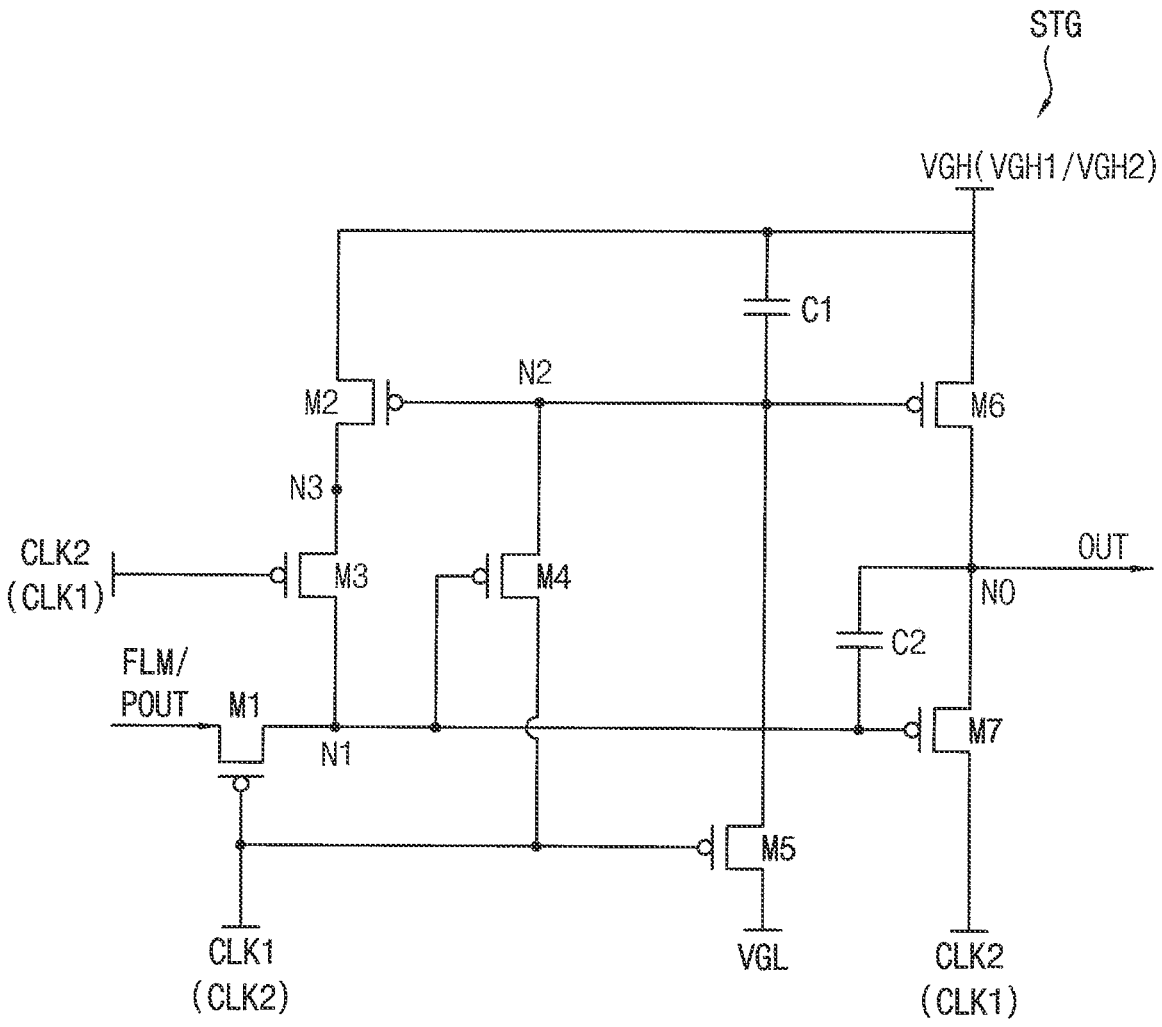
FIG. 21 is a circuit diagram illustrating a stage included in a scan driver according to embodiments.
Figure 22:
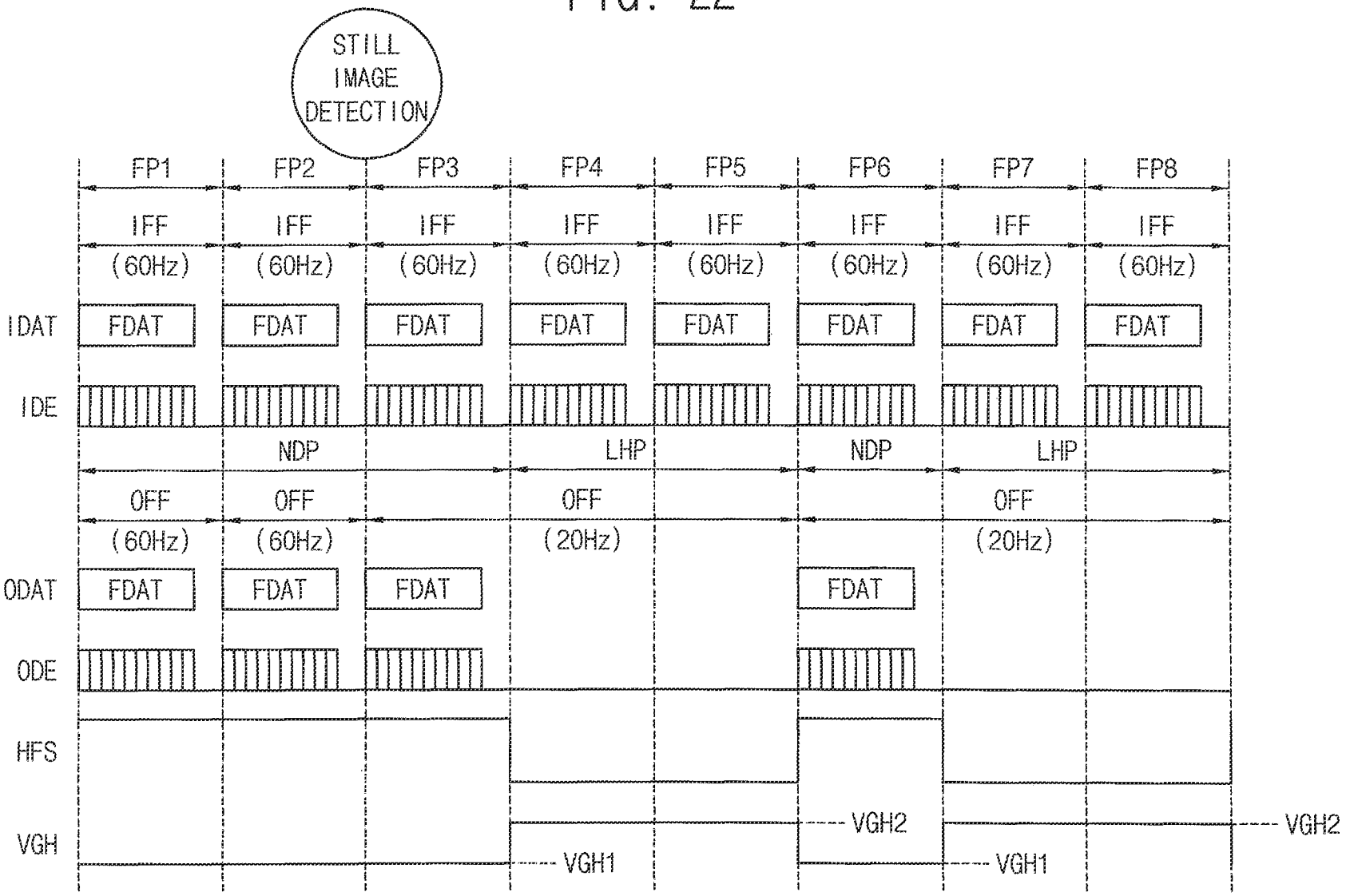
FIG. 22 is a timing diagram for describing an operation of an organic light emitting diode display device according to embodiments.

FIG. 18 is a block diagram illustrating an organic light emitting diode display device according to embodiments, FIG. 19 is a circuit diagram illustrating a switching block included in a power management circuit of an organic light emitting diode display device according to embodiments, FIG. 20 is a block diagram illustrating a scan driver included in an organic light emitting diode display device according to embodiments, FIG. 21 is a circuit diagram illustrating a stage included in a scan driver of FIG. 20, and FIG. 22 is a timing diagram for describing an operation of an organic light emitting diode display device according to embodiments.

Referring to FIG. 18, an organic light emitting diode display device 400 according to embodiments may include a display panel 410 that includes a plurality of pixels PX, a data driver 420 that provides data signals DS to the plurality of pixels PX, a power management circuit 430 that generates a gate on voltage VGL and a gate off voltage VGH, a scan driver 440 that provides scan signals SS and initialization signals SI to the plurality of pixels PX based on the gate on voltage VGL and the gate off voltage VGH, an emission driver 470 that provides emission signals SEM to the plurality of pixels PX, and a controller 480 that controls an operation of the organic light emitting diode display device 400.

The display panel 410 may include a plurality of data signal lines, a plurality of scan signal lines, a plurality of initialization signal lines, a plurality of emission signal lines, and the plurality of pixels PX coupled to the signal lines. According to embodiments, each pixel PX may be a pixel 100 of FIG. 1, a pixel 100*a* of FIG. 4, a pixel 100*b* of FIG. 8, a pixel 100*c* of FIG. 10, a pixel 100*d* of FIG. 13, a pixel 100*e* of FIG. 15, a pixel 100*f* of FIG. 17, or the like. An off voltage level of the scan signal SS applied to a third transistor and the initialization signal SI applied to a fourth transistor of each pixel PX may be adjusted in a low frequency hold period.

The data driver 420 may generate the data signals DS based on a data control signal DCTRL and output image data ODAT received from the controller 480, and may provide the data signals DS to the plurality of pixels PX through the plurality of data signal lines. The data control signal DCTRL may include an output data enable signal ODE, a horizontal start signal and a load signal. The data driver 420 may receive the output image data ODAT at an output frame frequency OFF from the controller 480. The data driver 420 may receive the output image data ODAT at the output frame frequency OFF substantially the same as an input frame frequency IFF when a moving image is displayed, and may receive the output image data ODAT at the output frame frequency OFF lower than the input frame frequency IFF when a still image is displayed. Further, the data driver 420 may receive the output data enable signal ODE in synchronization with the output image data ODAT. The data driver 420 and the controller 480 may be implemented with a signal integrated circuit, and the signal integrated circuit may be referred to as a timing controller embedded data driver (TED). The data driver 420 and the controller 480 may be implemented with separate integrated circuits.

The power management circuit 430 may generate the gate on voltage VGL and the gate off voltage VGH provided to the scan driver 440. The gate on voltage VGL may be a low gate voltage VGL, and the gate off voltage VGH may be a high gate voltage VGH. The power management circuit 430 may be implemented with an integrated circuit, for example a power management integrated circuit (PMIC). The power management circuit 430 may be included in the data driver 420 or the controller 480.

In a normal driving period, the power management circuit 430 may provide a first gate off voltage VGH1 as the gate off voltage VGH to an initialization stage group 450 and a scan stage group 460 of the scan driver 440. In the low frequency hold period, the power management circuit 430 may provide the first gate off voltage VGH1 as the gate off voltage VGH to a first group of the initialization stage group 450 and the scan stage group 460, and may provide a second gate off voltage VGH2 different from the first gate off voltage VGH1 as the gate off voltage VGH to a second group of the initialization stage group 450 and the scan stage group 460. Although FIG. 18 illustrates that the power management circuit 430 selectively provides the first gate off voltage VGH1 or the second gate off voltage VGH2 to the initialization stage group 450, the first gate off voltage VGH1 or the second gate off voltage VGH2 may be selectively provided to the scan stage group 460 and/or the initialization stage group 450.

In the low frequency hold period, to provide the initialization signal SI having the second gate off voltage VGH2 higher than the first gate off voltage VGH1 to each pixel PX as illustrated in FIG. 3, the power management circuit 430 may provide, as the gate off voltage VGH, the second gate off voltage VGH2 higher than the first gate off voltage VGH1 to the initialization stage group 450.

In the low frequency hold period, to provide the scan signal SS having the second gate off voltage VGH2 higher than the first gate off voltage VGH1 to each pixel PX as illustrated in FIG. 7, the power management circuit 430 may provide, as the gate off voltage VGH, the second gate off voltage VGH2 higher than the first gate off voltage VGH1 to the scan stage group 460.

In the low frequency hold period, to provide the initialization signal SI having the second gate off voltage VGH2 lower than the first gate off voltage VGH1 to each pixel PX as illustrated in FIG. 9, the power management circuit 430 may provide, as the gate off voltage VGH, the second gate off voltage VGH2 lower than the first gate off voltage VGH1 to the initialization stage group 450.

In the low frequency hold period, to provide the scan signal SS having the second gate off voltage VGH2 lower than the first gate off voltage VGH1 to each pixel PX as illustrated in FIG. 12, the power management circuit 430 may provide, as the gate off voltage VGH, the second gate off voltage VGH2 lower than the first gate off voltage VGH1 to the scan stage group 460.

In the low frequency hold period, to provide the initialization signal SI and the scan signal SS having the second gate off voltage VGH2 higher than the first gate off voltage VGH1 to each pixel PX as illustrated in FIG. 14, the power management circuit 430 may provide, as the gate off voltage VGH, the second gate off voltage VGH2 higher than the first gate off voltage VGH1 to the initialization stage group 450 and the scan stage group 460.

In the low frequency hold period, to provide the initialization signal SI and the scan signal SS having the second gate off voltage VGH2 lower than the first gate off voltage VGH1 to each pixel PX as illustrated in FIG. 16, the power management circuit 430 may provide, as the gate off voltage VGH, the second gate off voltage VGH2 lower than the first gate off voltage VGH1 to the initialization stage group 450 and the scan stage group 460.

To selectively provide the first gate off voltage VGH1 or the second gate off voltage VGH2 to at least one group of the initialization stage group 450 and the scan stage group 460, the power management circuit 430 may include a switching block 435. The switching block 435 may receive a hold flag signal HFS representing the low frequency hold period from the controller 480, and may selectively provide the first gate off voltage VGH1 or the second gate off voltage VGH2 as the gate off voltage VGH to the at least one group in response to the hold flag signal HFS.

As illustrated in FIG. 19, the switching block 435 may include a first switch SWS1 that provides the first gate off voltage VHG1 as the gate off voltage VGH to the at least one group in response to the hold flag signal HFS, and a second switch SWS2 that provides the second gate off voltage VGH2 as the gate off voltage VGH to the at least one group in response to the hold flag signal HFS. For example, as illustrated in FIG. 19, the first switch SWS1 may be implemented with an NMOS transistor, and the second switch SWS2 may be implemented with a PMOS transistor.

The scan driver 440 may receive the gate on voltage VGL and the gate off voltage VGH from the power management circuit 430, may receive a scan control signal from the controller 480, and may generate the scan signals SS and the initialization signals SI based on the gate on voltage VGL, the gate off voltage VGH, and the scan control signal. The scan driver 440 may sequentially provide the initialization signals SI to the plurality of pixels PX through the plurality of initialization signal lines on a row-by-row basis, and may sequentially provide the scan signals SS to the plurality of pixels PX through the plurality of scan signal lines on a row-by-row basis. The scan control signal may include an initialization start signal SI_FLM, an initialization clock signal SI_CLK, a scan start signal SS_FLM, and a scan clock signal SS_CLK. The scan driver 440 may be integrated or formed in a peripheral portion of the display panel 410. The scan driver 440 may be implemented with one or more integrated circuits.

As illustrated in FIGS. 18 and 20, the scan driver 440 may include the initialization stage group 450 that sequentially provides the initialization signals SI to the plurality of pixels PX based on the gate on voltage VGL and the gate off voltage VGH, and the scan stage group 460 that sequentially provides the scan signals SS to the plurality of pixels PX based on the gate on voltage VGL and the gate off voltage VGH. For example, as illustrated in FIG. 20, the initialization stage group 450 may include a plurality of serially connected initialization stages SI_STG1, SI_STG2, SI_STG3, . . . that receive the initialization start signal SI_FLM, a first initialization clock signal SI_CLK1, and a second initialization clock signal SI_CLK2; the scan stage group 460 may include a plurality of serially connected scan stages SS_STG1, SS_STG2, SS_STG3, . . . that receive the scan start signal SS_FLM, a first scan clock signal SS_CLK1, and a second scan clock signal SS_CLK2.

As illustrated in FIG. 21, each stage STG of the plurality of initialization stages SI_STG1, SI_STG2, SI_STG3, . . . and the plurality of scan stages SS_STG1, SS_STG2, SS_STG3, . . . may include first through seventh transistors M1 through M7 and first and second capacitors C1 and C2. In each stage STG, the first transistor M1 may transfer a start signal FLM (e.g., the initialization start signal SI_FLM or the initialization start signal SI_FLM) or a previous output signal POUT to a first node N1 in response to a first clock signal CLK1 (e.g., the first initialization clock signal SI_CLK1 or the first scan clock signal SS_CLK1), the second transistor M2 may transfer the gate off voltage VGH to a third node N3 in response to a voltage of a second node N2, the third transistor M3 may transfer a voltage of the third node N3 to the first node N1 in response to a second clock signal CLK2 (e.g., the second initialization clock signal SI_CLK2 or the second scan clock signal SS_CLK2), the fourth transistor M4 may transfer the first clock signal CLK1 to the second node N2 in response to a voltage of the first node N1, the fifth transistor M5 may transfer the gate on voltage VGL to the second node N2 in response to the first clock signal CLK1, the sixth transistor M6 may output the gate off voltage VGH as an output signal OUT to an output node NO in response to the voltage of the second node N2, and the seventh transistor M7 may output the second clock signal CLK2 as the output signal OUT to the output node NO in response to the voltage of the first node N1. The first capacitor C1 may be coupled between a line of the gate off voltage VGH and the second node N2, and the second capacitor C2 may be coupled between the first node N1 and the output node NO. Accordingly, when a stage STG receives the first gate off voltage VGH1 as the gate off voltage VGH in the low frequency hold period, the stage STG may output the first gate off voltage VGH1 as the output signal OUT (e.g., the initialization signal SI or the scan signal SS) in the low frequency hold period. When a stage STG receives the second gate off voltage VGH2 as the gate off voltage VGH in the low frequency hold period, the stage STG may output the second gate off voltage VGH2 as the output signal OUT (e.g., the initialization signal SI or the scan signal SS) in the low frequency hold period.

The organic light emitting diode display device 400 may include the initialization stage group 450 generating the initialization signals SI and may include the scan stage group 460 generating the scan signals SS. Accordingly, since the scan signal SS and the initialization signal SI are generated by different stage groups 450 and 460, the scan signal SS and the initialization signal SI can be adjusted to have different off voltage levels in the low frequency hold period.

The emission driver 470 may generate the emission signals SEM based on an emission control signal EMCTRL received from the controller 480, and may provide the emission signals SEM to the plurality of pixels PX through the plurality of emission signal lines. The emission signals SEM may be sequentially provided to the plurality of pixels PX on a row-by-row basis. The emission signals SEM may be a global signal that is substantially simultaneously provided to the plurality of pixels PX. The emission driver 470 may be integrated or formed in the peripheral portion of the display panel 410. The emission driver 470 may be implemented with one or more integrated circuits.

The controller (e.g., a timing controller (TCON)) 480 may receive input image data IDAT and a control signal CTRL from an external host, e.g., an application processor (AP), a graphic processing unit (GPU), or a graphic card. The control signal CTRL may include a vertical synchronization signal, a horizontal synchronization signal, an input data enable signal IDE, a master clock signal, etc. The controller 480 may generate the output image data ODAT, the data control signal DCTRL, the scan control signal, the emission control signal EMCTRL, and the hold flag signal HFS based on the input image data IDAT and the control signal CTRL. The controller 480 may control an operation of the data driver 420 by providing the output image data ODAT and the data control signal DCTRL to the data driver 420, may control an operation of the scan driver 440 by providing the scan control signal to the scan driver 440, may control an operation of the emission driver 470 by providing the emission control signal EMCTRL to the emission driver 470, and may control an operation of the power management circuit 430 by providing the hold flag signal HFS to the power management circuit 430.

The organic light emitting diode display device 400 may detect whether the input image data IDAT represents a still image, may set at least one of consecutive frame periods as a low frequency hold period when the input image data IDAT represents the still image, and may perform low frequency driving that drives the display panel 410 at a low frequency lower than the input frame frequency IFF in the low frequency hold period. To perform the low frequency driving, the controller 480 of the organic light emitting diode display device 400 may include a still image detector 490.

The still image detector 490 may receive the input image data IDAT at the input frame frequency IFF, and may determine whether the input image data IDAT represents the still image. The still image detector 490 may determine whether the input image data IDAT represents the still image by comparing the input image data IDAT in a previous frame period and the input image data IDAT in a current frame period. For example, the still image detector 490 may store a representative value (e.g., an average value, a checksum, etc.) of the input image data IDAT in the previous frame period, may calculate a representative value of the input image data IDAT in the current frame period, and may determine whether the input image data IDAT represents the still image by comparing the stored representative value and the calculated representative value.

When the input image data IDAT represents the still image, to drive the display panel 410 at the low frequency or the output frame frequency OFF lower than the input frame frequency IFF, the controller 480 may set at least one of consecutive frame periods as a low frequency hold period, and may not provide a data voltage to the display panel 410 in the low frequency hold period. The controller 480 may control the data driver 420 not to provide data signals DS (or data voltages) to the plurality of pixels PX in the low frequency hold period. The controller 480 may control the scan driver 440 to provide adjusted scan signals SS or no scan signals SS and to provide adjusted initialization signals SI or no initialization signals SI to the plurality of pixels PX in the low frequency hold period. In the low frequency hold period, the emission driver 470 may provide the emission signals SEM to the plurality of pixels PX at the input frame frequency IFF such that the display panel 410 may periodically emit light. In the low frequency hold period, the power management circuit 430 may provide, as the gate off voltage VGH, the second gate off voltage VGH2 different from the first gate off voltage VGH1 to at least one of the initialization stage group 450 and the scan stage group 460. The initialization stage group 450 and/or the scan stage group 460 receiving the second gate off voltage VGH2 may apply the second gate off voltage VGH2 as the initialization signal SI and/or the scan signal SS to the respective pixels PX in the low frequency hold period. Accordingly, a distortion of a gate node voltage in the respective pixels PX may be compensated, and satisfactory image quality of the organic light emitting diode display device 400 may be attained.

Referring to FIG. 22, the controller 480 may receive the input image data IDAT at the normal driving frequency or the input frame frequency IFF of about 60 Hz, and may receive the input data enable signal IDE in synchronization with the input image data IDAT. For example, the controller 480 may receive, as the input image data IDAT, sixty frame data FDAT for about one second. In first and second frame periods FP1 and FP2 when the input image data IDAT does not represent a still image, or the input image data IDAT represents a moving image, the controller 480 may provide the data driver 420 with the output image data ODAT at the output frame frequency OFF of about 60 Hz that is substantially the same as the input frame frequency IFF, and may further provide the data driver 420 with the output data enable signal ODE in synchronization with the output image data ODAT. Accordingly, the display panel 110 may be driven at the normal driving frequency or the output frame frequency OFF of about 60 Hz.

When the still image detector 490 determines that the input image data IDAT represents a still image, the controller 480 may determine a driving frequency of the display panel 410 or the output frame frequency OFF as the low frequency lower than the normal driving frequency or the input frame frequency IFF. The controller 480 may determine a flicker value (representing a level of a flicker perceived by a user) corresponding to a gray level or luminance of the input image data IDAT, and may determine the driving frequency of the display panel 410 based on the flicker value. Referring to FIG. 22, the input frame frequency IFF is about 60 Hz, the low frequency or the output frame frequency OFF is determined as about 20 Hz, and the controller 480 may set two frame periods (e.g., FP4 and FP5) of three consecutive frame periods (e.g., FP3, FP4, and FP5) as a low frequency hold period LHP. The controller 480 may set fourth and fifth frame periods FP4 and FP5 of third through fifth frame periods FP3, FP4 and FP5 as a low frequency hold period LHP, and may set seventh and eighth frame periods FP7 and FP8 of sixth through eighth frame periods FP6, FP7, and FP8 as a low frequency hold period LHP.

In the low frequency hold period LHP, the controller 480 may control the data driver 420 not to provide data signals DS (or data voltages) to the plurality of pixels PX. For example, in the third frame period FP3, the controller 480 may provide the data driver 420 with the frame data FDAT as the output image data ODAT and the output data enable signal ODE synchronized with the output image data ODAT. In the low frequency hold period LHP, or in the fourth and fifth frame periods FP4 and FP5, the controller 480 may not provide the output image data ODAT and the output data enable signal ODE to the data driver 420. That is, the controller 480 may provide the data driver 420 with only one frame data FDAT in the three frame periods FP3, FP4 and FP5, and thus the data driver 420 may drive the display panel 410 at the low frequency or the output frame frequency OFF of about 20 Hz that is one third of the input frame frequency IFF of about 60 Hz.

In the low frequency hold period LHP, the controller 480 may provide the hold flag signal HFS representing the low frequency hold period LHP, and the switching block 435 of the power management circuit 430 may provide, as the gate off voltage VGH, the second gate off voltage VGH2 different from the first gate off voltage VGH1 in the normal driving period NDP to at least one group of the initialization stage group 450 and the scan stage group 460. Accordingly, the at least one group may apply the second gate off voltage VGH2 as the initialization signal SI and/or the scan signal SS to the respective pixels PX in the low frequency hold period LHP. Accordingly, the distortion of the gate node voltage in the respective pixels PX may be compensated, and satisfactory image quality of the organic light emitting diode display device 400 may be attained.

The organic light emitting diode display device 400 may perform the low frequency driving by detecting the still image, and may set at least one frame period as the low frequency hold period LHP when performing the low frequency driving. In the low frequency hold period LHP, the organic light emitting diode display device 400 may provide, as the initialization signal SI and/or the scan signal SS, the second gate off voltage VGH2 different from the first gate off voltage VGH1 in the normal driving period NDP to the pixels PX. Accordingly, the distortion of the gate node voltage in the respective pixels PX may be compensated, and satisfactory image quality of the organic light emitting diode display device 400 may be attained.

Figure 23:
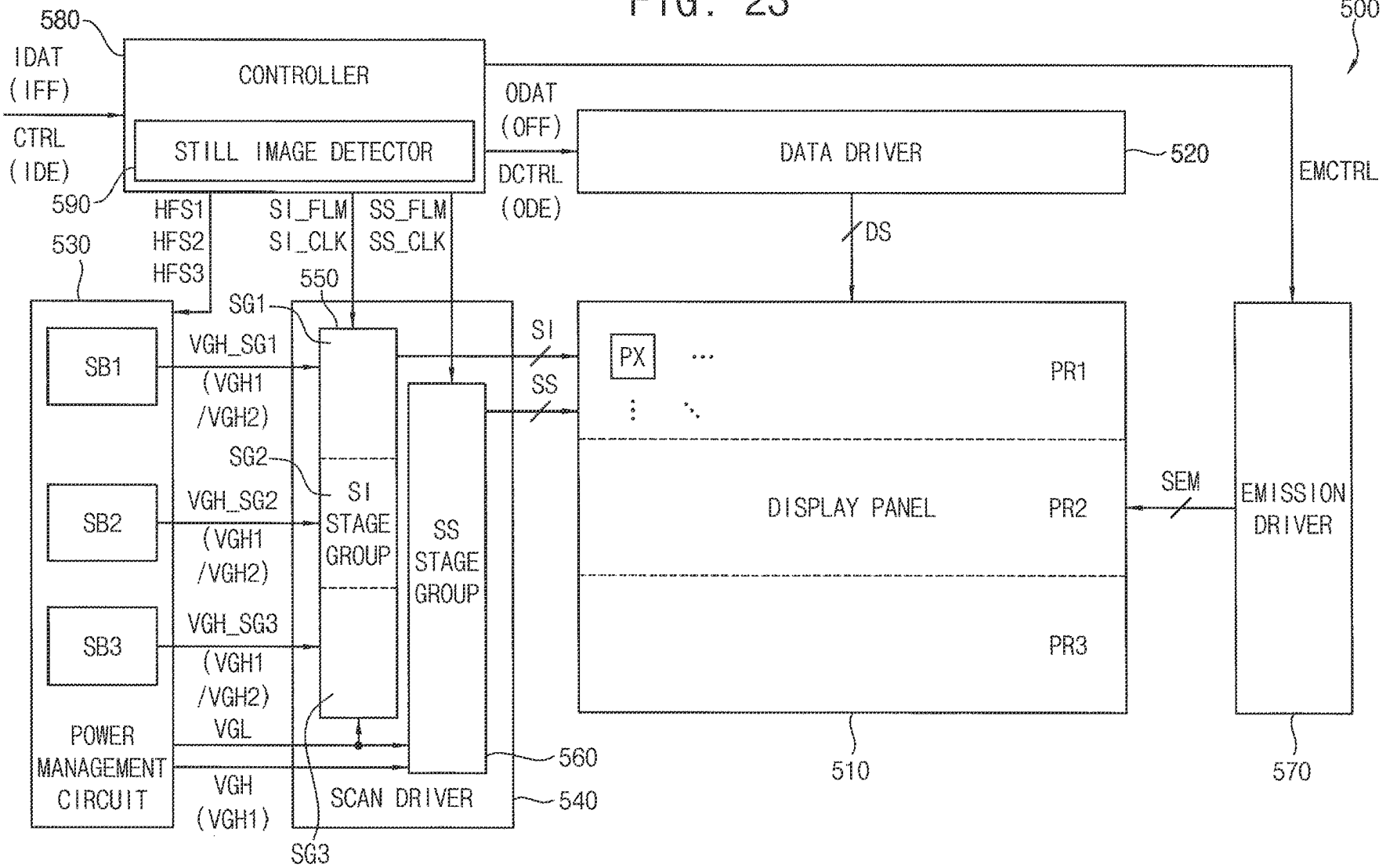
FIG. 23 is a block diagram illustrating an organic light emitting diode display device according to embodiments.
Figure 24:
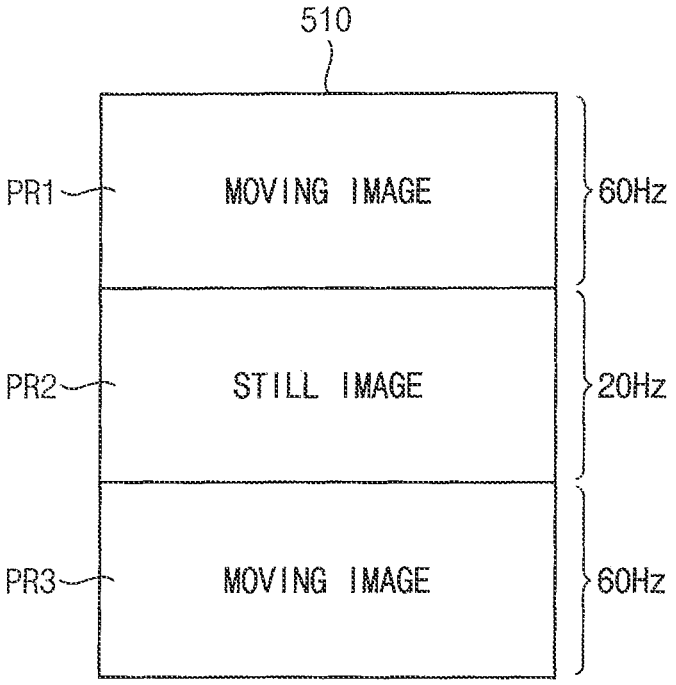
FIG. 24 is a diagram for describing panel regions of a display panel of an organic light emitting diode display device driven at different driving frequencies according to embodiments.
Figure 25:
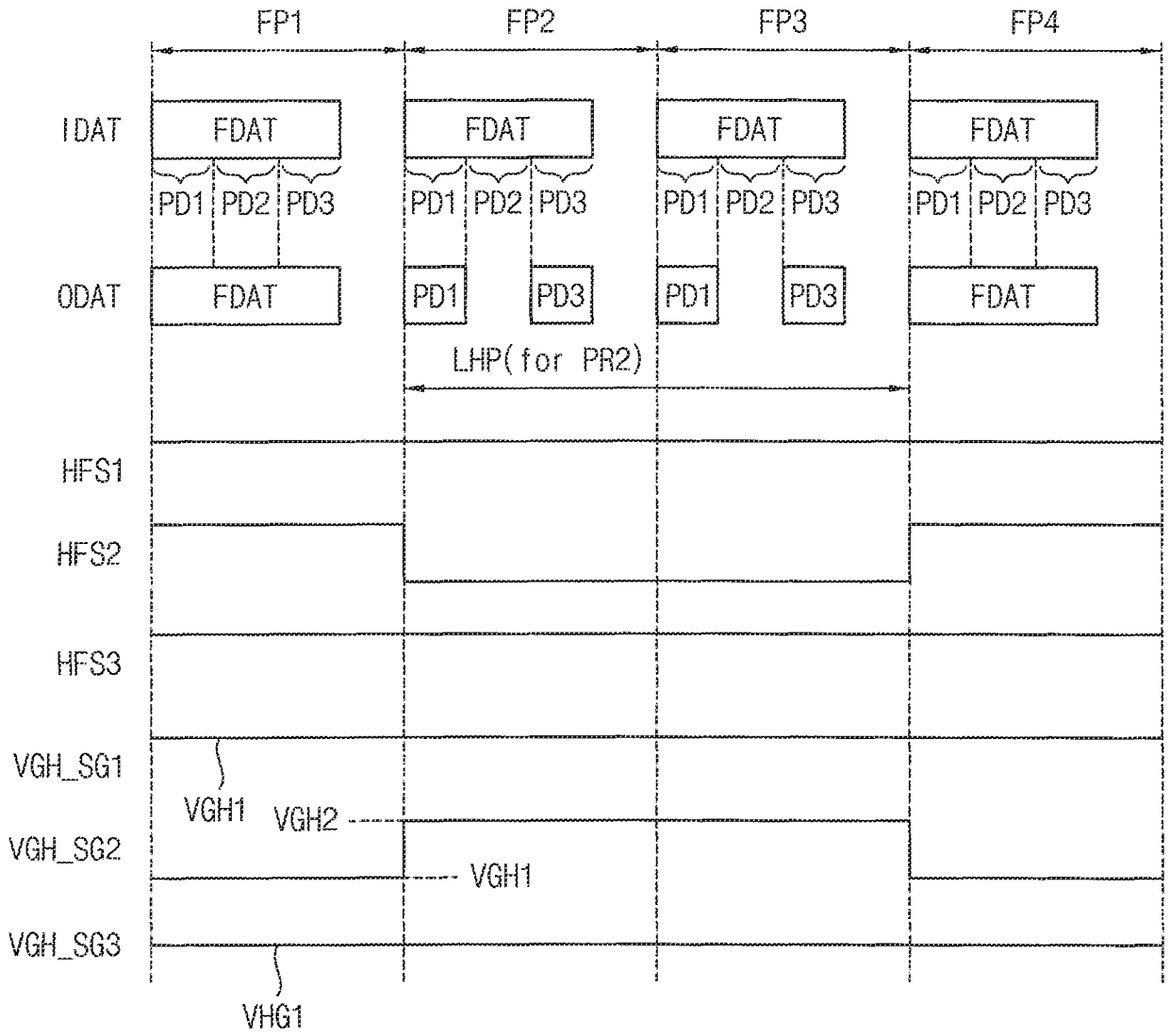
FIG. 25 is a timing diagram for describing an operation of an organic light emitting diode display device according to embodiments.

FIG. 23 is a block diagram illustrating an organic light emitting diode display device according to embodiments, FIG. 24 is a diagram for describing panel regions of a display panel of an organic light emitting diode display device of FIG. 23 driven at different driving frequencies, and FIG. 25 is a timing diagram for describing an operation of an organic light emitting diode display device according to embodiments.

Referring to FIG. 23, an organic light emitting diode display device 500 may include a display panel 510, a data driver 520, a power management circuit 530, a scan driver 540, an emission driver 570, and a controller 580. The organic light emitting diode display device 500 of FIG. 23 may have features similar to features of an organic light emitting diode display device 400 of FIG. 18, except that the display panel 510 may be divided into a plurality of panel regions PR1, PR2, and PR3, and the power management circuit 530 may include a plurality of switching blocks SB1, SB2, and SB3 that selectively provide a first gate off voltage VGH1 or a second gate off voltage VGH2 to stage sub-groups SG1, SG2, and SG3 respectively coupled to the panel regions PR1, PR2, and PR3.

The organic light emitting diode display device 500 may perform multi-frequency driving (MFD) that drives the panel regions PR1, PR2, and PR3 at different driving frequencies. Accordingly, different low frequency hold periods may be set with respect to the panel regions PR1, PR2, and PR3, and off voltage levels of initialization signals SI and/or scan signals SS for the panel regions PR1, PR2, and PR3 may be independently controlled.

To perform these operations, a still image detector 590 of the controller 580 may receive input image data IDAT at an input frame frequency IFF, and may divide the input image data IDAT for the display panel 510 into partial image data for the panel regions PR1, PR2, and PR3. The still image detector 590 may determine whether each partial image data represents a still image. When at least one partial image data of the plurality of partial image data represents a still image, to drive at least one of the panel regions PR1, PR2, and PR3 corresponding to the at least one partial image data at a low frequency lower than the input frame frequency IFF, the controller 580 may set at least one of consecutive frame periods as a low frequency hold period with respect to the at least one of the panel regions PR1, PR2, and PR3.

Referring to FIGS. 24 and 25, the still image detector 590 may divide the input image data IDAT, or frame data FDAT for the display panel 510 into first through third partial image data PD1, PD2, and PD3 for first through third panel regions PR1, PR2, and PR3. When the first partial image data PD1 for the first panel region PR1 represents a moving image, and when the third partial image data PD3 for the third panel region PR3 represents a moving image, driving frequencies for the first panel region PR1 and the third panel region PR3 may be determined as a normal driving frequency, for example about 60 Hz. Accordingly, the first and third partial image data PD1 and PD3 for the first and third panel regions PR1 and PR3 may be provided to the data driver 520 at an output frame frequency OFF of about 60 Hz, and the first and third panel regions PR1 and PR3 may be driven at the normal driving frequency of about 60 Hz. The controller 580 may provide first and third hold flag signals HFS1 and HFS3 having a high level to first and third switching blocks SB1 and SB3 of the power management circuit 530, the first and third switching blocks SB1 and SB3 may provide a first gate off voltage VGH1 as gate off voltages VGH_SG1 and VGH_SG3 for first and third stage sub-groups SG1 and SG3 of an initialization stage group 550 in response to the first and third hold flag signals HFS1 and HFS3 having the high level, and the first and third stage sub-groups SG1 and SG3 may apply the first gate off voltage VGH1 as the initialization signal SI having an off voltage level to the first and third panel regions PR1 and PR3. Although FIG. 23 illustrates that the initialization stage group 550 includes the stage sub-groups SG1, SG2 and SG3 receiving different gate off voltages VGH_SG1, VGH_SG2, and VGH_SG3, a scan stage group 560, instead of the initialization stage group 550 or along with the initialization stage group 550, may include the stage sub-groups SG1, SG2, and SG3 receiving the different gate off voltages VGH_SG1, VGH_SG2, and VGH_SG3.

When the second partial image data PD2 for the second panel region PR2 represents a still image, a driving frequency for the second panel region PR2 may be determined as a low frequency lower than the normal driving frequency, for example as about 20 Hz. To drive the second panel region PR2 at the low frequency of about 20 Hz, two frame periods FP2 and FP3 of three consecutive frame periods FP1, FP2, and FP3 may be set as a low frequency hold period LHP with respect to the second panel region PR2. In the low frequency hold period LHP for the second panel region PR2, the controller 580 may not provide the second partial image data PD2 to the data driver 520, such that no data signals DS may be provided to the second panel region PR2.

In the low frequency hold period LHP, the controller 580 may provide a second hold flag signal HFS2 having a low level to a second switching block SB2 of the power management circuit 530, the second switching block SB2 may provide a second gate off voltage VGH2 different from the first gate off voltage VGH1 as a gate off voltage VGH_SG2 for a second stage sub-group SG2 of the initialization stage group 550 in response to the second hold flag signal HFS2 having the low level, and the second stage sub-group SG2 may apply the second gate off voltage VGH2 as the initialization signal SI having the off voltage level to the second panel region PR2. Accordingly, a distortion of a gate node voltage at the second panel region PR2 may be compensated, and satisfactory image quality of the organic light emitting diode display device 500 may be attained.

The organic light emitting diode display device 500 may perform the MFD that drives the panel regions PR1, PR2, and PR3 at different driving frequencies. When a panel region is driven at the low frequency, at least one frame period for the panel region may be set as the low frequency hold period LHP. In the low frequency hold period LHP for the panel region, the organic light emitting diode display device 500 may provide the second gate off voltage VGH2 different from the first gate off voltage VGH1 in a normal driving period NDP as the initialization signal SI and/or the scan signal SS to each pixel PX in the panel region. Accordingly, the distortion of the gate node voltage in the respective pixels PX in the panel region may be compensated, and satisfactory image quality of the organic light emitting diode display device 500 may be attained.

Figure 26:
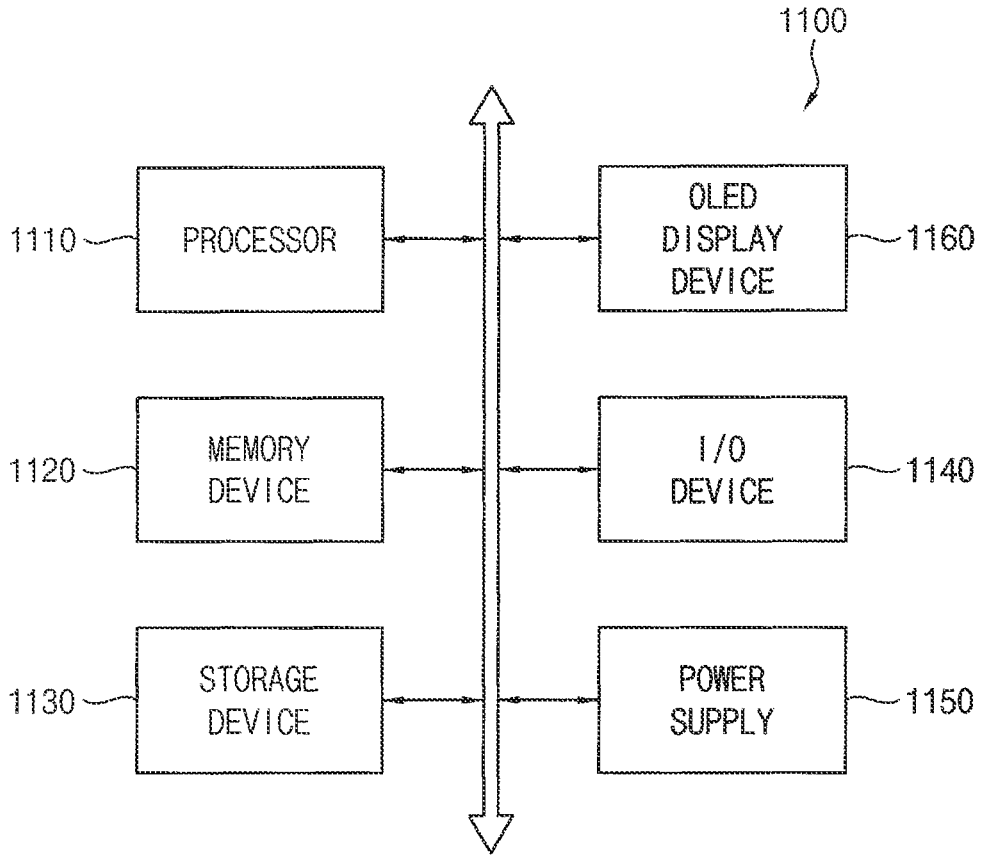
FIG. 26 is an electronic device including an organic light emitting diode display device according to embodiments.

FIG. 26 is an electronic device including an organic light emitting diode display device according to embodiments.

Referring to FIG. 26, an electronic device 1100 may include a processor 1110, a memory device 1120, a storage device 1130, an input/output (I/O) device 1140, a power supply 1150, and an organic light emitting diode display device 1160. The electronic device 1100 may further include ports for communicating with a video card, a sound card, a memory card, a universal serial bus (USB) device, other electric devices, etc.

The processor 1110 may perform various computing functions or tasks. The processor 1110 may be an application processor (AP), a microprocessor, a central processing unit (CPU), etc. The processor 1110 may be coupled to other components via an address bus, a control bus, a data bus, etc. The processor 1110 may be coupled to an extended bus such as a peripheral component interconnection (PCI) bus.

The memory device 1120 may store data for operations of the electronic device 1100. For example, the memory device 1120 may include at least one non-volatile memory device, such as at least one of an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device such as a dynamic random access memory (DRAM) device, a static random access memory (SRAM) device, a mobile dynamic random access memory (mobile DRAM) device, etc.

The storage device 1130 may be/include at least one of a solid state drive (SSD) device, a hard disk drive (HDD) device, a CD-ROM device, etc. The I/O device 1140 may include at least one an input device (such as one of a keyboard, a keypad, a mouse, and a touch screen) and an output device (such as one of a printer and a speaker). The power supply 1150 may supply power for operations of the electronic device 1100. The organic light emitting diode display device 1160 may be coupled to other components through the buses or other communication links.

In each pixel of the organic light emitting diode display device 1160, an off voltage level of at least one of a scan signal applied to a third transistor (e.g., a threshold voltage compensating transistor) and an initialization signal applied to a fourth transistor (e.g., a gate initializing transistor) may be changed in a low frequency hold period. Accordingly, a voltage distortion of a gate node of a first transistor (e.g., a driving transistor) at low frequency driving may be compensated, and satisfactory image quality of the organic light emitting diode display device 1160 may be attained.

Embodiments may be applied to an organic light emitting diode display device 1160 and/or an electronic device 1100 including the organic light emitting diode display device 1160. For example, embodiments may be applied to a mobile phone, a smart phone, a wearable electronic device, a tablet computer, a television (TV), a digital TV, a 3D TV, a personal computer (PC), a home appliance, a laptop computer, a personal digital assistant (PDA), a portable multimedia player (PMP), a digital camera, a music player, a portable game console, a navigation device, etc.

The foregoing is illustrative and is not limiting. Although embodiments have been described, many modifications are possible in the embodiments. All modifications are intended to be included within the scope defined in the claims.

What is claimed is:

1. A pixel of a display device, the display device having a first mode and a second mode, a driving frequency of the second mode being lower than a driving frequency of the first mode, the pixel comprising:

a first transistor including a first electrode, a second electrode and a third electrode;

a second transistor, wherein a third electrode of the second transistor is electrically connected to the second electrode of the first transistor, and wherein a first electrode of the second transistor receives a first signal;

a third transistor electrically connecting the first electrode of the first transistor and the third electrode of the first transistor in response to the first signal;

a fourth transistor transferring an initialization voltage to the first electrode of the first transistor in response to a second signal; and a light emitting element, wherein in the second mode, the first signal and the second signal have different off voltage levels.

2. The pixel of claim 1, further comprising:

a capacitor, wherein a first electrode of the capacitor receives a power supply voltage, and wherein a second electrode of the capacitor is electrically connected to the first electrode of the first transistor.

3. The pixel of claim 1, wherein in a frame period in the first mode, the first signal changes from an on voltage level to a first off voltage level at a first time, and the second signal changes from the on level to the first off voltage level at a second time different from the first time, and wherein in the second mode, the second signal is changed from the first off voltage level to a second off voltage level higher than the first off voltage level.

4. The pixel of claim 3, wherein in the second mode, a leakage current of the fourth transistor is increased based on a difference between the second off voltage level and the first off voltage level.

5. The pixel of claim 3, wherein a difference between the second off voltage level and the first off voltage level depends on the driving frequency of the second mode.

6. The pixel of claim 1, wherein in a frame period in the first mode, the first signal changes from an on voltage level to a first off voltage level at a first time, and the second signal changes from the on level to the first off voltage level at a second time different from the first time, and wherein in the second mode, the first signal is changed from the first off voltage level to a second off voltage level higher than the first off voltage level.

7. The pixel of claim 6, wherein in the second mode, a leakage current of the third transistor from the first electrode of the first transistor to the third electrode of the first transistor is increased based on a difference between the first off voltage level and the second off voltage level.

8. The pixel of claim 1, wherein in a frame period in the first mode, the first signal changes from an on voltage level to a first off voltage level at a first time, and the second signal changes from the on level to the first off voltage level at a second time different from the first time, and wherein in the second mode, the second signal is changed from the first off voltage level to a second off voltage level lower than the first off voltage level.

9. The pixel of claim 8, wherein in the second mode, a leakage current of the fourth transistor is decreased based on a difference between the second off voltage level and the first off voltage level.

10. The pixel of claim 1, wherein in a frame period in the first mode, the first signal changes from an on voltage level to a first off voltage level at a first time, and the second signal changes from the on level to the first off voltage level at a second time different from the first time, and wherein in the second mode, the first signal is changed from the first off voltage level to a second off voltage level lower than the first off voltage level.

11. The pixel of claim 10 wherein in the second mode, a leakage current of the third transistor is decreased based on a difference between the first off voltage level and the second off voltage level.

12. The pixel of claim 1, wherein the third transistor includes a first sub-transistor and a second sub-transistor that are electrically connected in series between the first electrode of the first transistor and the third electrode of the first transistor, and wherein the fourth transistor includes a third sub-transistor and a fourth sub-transistor that are electrically connected in series between the first electrode of the first transistor and a source of the initialization voltage.

13. The pixel of claim 1, further comprising:

a fifth transistor, wherein a first electrode of the fifth transistor is electrically connected to an emission signal source, wherein a second electrode of the fifth transistor receives a power supply voltage, and wherein a third electrode of the fifth transistor is electrically connected to the second electrode of the first transistor;

a sixth transistor, wherein a first electrode of the sixth transistor is electrically connected to the emission signal source, wherein a second electrode is electrically connected to the third electrode of the first transistor, and wherein a third electrode of the sixth transistor is electrically connected to the light emitting element; and a seventh transistor, wherein a first electrode of the seventh transistor receives the second signal, wherein a second electrode of the seventh transistor is electrically connected to the light emitting element, and wherein a third electrode of the seventh transistor is electrically connected to a source of the initialization voltage.

14. A pixel of a display device, the display device having a first mode and a second mode, a driving frequency of the second mode being lower than a driving frequency of the first mode, the pixel comprising:

a first transistor including a first electrode, a second electrode and a third electrode;

a second transistor, wherein a third electrode of the second transistor is electrically connected to the second electrode of the first transistor, and wherein a first electrode of the second transistor receives a first signal;

a third transistor electrically connecting the first electrode of the first transistor and the third electrode of the first transistor in response to the first signal;

a fourth transistor transferring an initialization voltage to the first electrode of the first transistor in response to a second signal; and a light emitting element, wherein at an end of a frame period in the first mode, each of the first signal and the second signal is at a first off voltage level, and wherein in the second mode, at least one of the first signal and the second signal is at a second off voltage level unequal to the first off voltage level.

15. A display device comprising:

a display panel including pixels;

a data driver electrically connected to the display panel and configured to provide data signals to the pixels;

a power management circuit; and a scan driver electrically connected to the power management circuit, electrically connected to the display panel, configured to sequentially provide first signals to the pixels, and configured to sequentially provide second signals to the pixels, wherein in a first mode of the display device, the power management circuit provides a first gate off voltage to the scan driver, and wherein in a second mode of the display device, the power management circuit provides the first gate off voltage and a second gate off voltage unequal to the first gate off voltage to the scan driver such that each of the first signals and each of the second signals have different off voltage levels.

16. The display device of claim 15, wherein the power management circuit includes a first stage group configured to sequentially provide the first signals to the pixels, and a second stage group configured to sequentially provide the second signals to the pixels, and wherein the power management circuit includes:

a switching block configured to receive a hold flag signal, and configured to selectively provide the first gate off voltage or the second gate off voltage to at least one of the initialization stage group and the scan stage group in response to the hold flag signal.

17. The display device of claim 16, wherein the switching block includes:

a first switch configured to provide the first gate off voltage to the at least one of the initialization stage group and the scan stage group in response to the hold flag signal; and a second switch configured to provide the second gate off voltage to the at least one of the initialization stage group and the scan stage group in response to the hold flag signal.

18. The display device of claim 15, further comprising:

a still image detector configured to receive input image data at an input frame frequency, and wherein when the still image detector determines that the input image data represents a still image, at least one of consecutive frame periods is set as a hold period in the second mode, such that the display panel operates in the second mode at a frequency lower than the input frame frequency.

19. The display device of claim 15, wherein the display panel is divided into panel regions, wherein the display device further comprises:

a still image detector configured to receive input image data for the display panel at an input frame frequency and to divide the input image data into partial image data sets for the panel regions, respectively, and wherein when the still image detector determines that an identified partial image data set of the partial image data sets represents a still image, at least one of consecutive frame periods is set as a hold period in the second mode for a corresponding panel region of the panel regions that corresponds to the identified partial image data set, such that the corresponding panel region operates in the second mode at a frequency lower than the input frame frequency.

20. The display device of claim 19, wherein the power management circuit includes a first stage group configured to sequentially provide the first signals to the pixels, and a second stage group configured to sequentially provide the second signals to the pixels, wherein at least one of the first stage group and the second stage group includes stage sub-groups respectively electrically connected to the panel regions, and wherein the power management circuit includes:

switching blocks respectively electrically connected to the stage sub-groups and configured to selectively provide the first gate off voltage or the second gate off voltage to each of the stage sub-groups.

* * * * *